US008105147B2

(12) United States Patent
Inamura

(10) Patent No.: US 8,105,147 B2
(45) Date of Patent: Jan. 31, 2012

(54) GAMING MACHINE PERFORMING NEW GAME BY USING CONTENTS OF GAME OF PLURAL GAME TERMINALS AND PLAYING METHOD THEREOF

(75) Inventor: Yukinori Inamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 579 days.

(21) Appl. No.: 12/236,899

(22) Filed: Sep. 24, 2008

(65) Prior Publication Data

US 2009/0239623 A1 Sep. 24, 2009

Related U.S. Application Data

(60) Provisional application No. 61/038,639, filed on Mar. 21, 2008.

(51) Int. Cl.
*A63F 9/24* (2006.01)

(52) U.S. Cl. ..... 463/16; 463/20; 463/25; 463/29

(58) Field of Classification Search ..... 463/16–20, 463/25–29

See application file for complete search history.

(56) References Cited

U.S. PATENT DOCUMENTS

| | | | | |
|---|---|---|---|---|
| 4,283,709 | A | 8/1981 | Lucero et al. | |
| 5,820,459 | A | 10/1998 | Acres et al. | |
| 6,003,013 | A | 12/1999 | Boushy et al. | |
| 2008/0026848 | A1 * | 1/2008 | Byng | 463/42 |

* cited by examiner

*Primary Examiner* — Omkar Deodhar
(74) *Attorney, Agent, or Firm* — NDQ & M Watchstone LLP

(57) ABSTRACT

A gaming machine of the present invention has a common display, terminal devices, and a mother board and a central control board. The mother board and the central control board make control of: extracting a predetermined number of terminal devices from the terminal devices; bringing side-bet coin receiving slots of the extracted terminal devices into a selectable state; repeating the above processes until the number of terminal devices having selected to participate in a game occurring on the common display reaches a predetermined value; extracting symbols, on a line or column basis, from the symbols rearranged in the matrixes of the predetermined number of terminal devices having selected to participate in a side-bet game; rearranging, on the common display, a combination of the symbols extracted on a line or column basis; and awarding a bonus payout to the terminal devices having selected to participate in the game.

7 Claims, 19 Drawing Sheets

BASIC GAME RUNNING SCREEN IN EACH TERMINAL DEVICE

FIG. 7

| | Symbol Line A | Symbol Line B | Symbol Line C | Symbol Line D | Symbol Line E |
|---|---|---|---|---|---|
| CODE NO. | SYMBOL | SYMBOL | SYMBOL | SYMBOL | SYMBOL |
| 00 | SUN | J | J | HEART | 10 |
| 01 | 10 | HEART | MOON | SUN | J |
| 02 | SUN | J | SUN | 10 | SUN |
| 03 | A | HEART | J | K | HEART |
| 04 | SUN | 10 | A | HEART | J |
| 05 | 10 | SUN | 10 | A | Q |
| 06 | SUN | A | SUN | J | SUN |
| 07 | A | MOON | K | Q | J |
| 08 | Q | HEART | A | 10 | A |
| 09 | MOON | J | K | SUN | HEART |
| 10 | SUN | HEART | SUN | HEART | Q |
| 11 | HEART | K | 10 | SUN | 10 |
| 12 | SUN | MOON | HEART | 10 | HEART |
| 13 | K | Q | Q | MOON | SUN |
| 14 | Q | HEART | SUN | J | J |
| 15 | SUN | J | HEART | K | A |
| 16 | J | HEART | MOON | MOON | MOON |
| 17 | K | K | 10 | HEART | SUN |
| 18 | SUN | 10 | SUN | 10 | HEART |
| 19 | 10 | MOON | 10 | SUN | SUN |
| 20 | Q | HEART | SUN | MOON | 10 |
| 21 | MOON | SUN | Q | A | K |

FIG. 10

BASE GAME WINNING COMBINATION LOTTERY TABLE

130

| WINNING COMBINATION | RANDOM NUMERICAL VALUE |
|---|---|
| ☀×5 | 0～29 |
| ♥×5 | 30～51 |
| ☾×5 | 52～107 |
| K×5 | 108～207 |
| A×5 | 208～407 |
| Q×5 | 408～807 |
| J×5 | 808～1477 |
| 10×5 | 1478～1807 |
| LOSING | 1808～5998 |

FIG. 11

BASE GAME PAYOUT TABLE

131

| WINNING COMBINATION | PAYOUT (OF COINS) |
|---|---|
| ☀ × 5 | 70COINS |
| ♥ × 5 | 50COINS |
| ☾ × 5 | 30COINS |
| K × 5 | 25COINS |
| A × 5 | 20COINS |
| Q × 5 | 15COINS |
| J × 5 | 10COINS |
| 10 × 5 | 5COINS |
| LOSING | 0COIN |

FIG. 12

SIDE-BET GAME PAYOUT TABLE

133

| WINNING COMBINATION | PAYOUT (OF COINS) |
|---|---|
| ☀×5 | 80COINS |
| ♥×5 | 70COINS |
| ☾×5 | 60COINS |
| K×5 | 50COINS |
| A×5 | 30COINS |
| Q×5 | 20COINS |
| J×5 | 10COINS |
| 10×5 | 6COINS |
| LOSING | 0COIN |

INITIAL PROCESS

GAMING MACHINE PERFORMING NEW GAME BY USING CONTENTS OF GAME OF PLURAL GAME TERMINALS AND PLAYING METHOD THEREOF

CROSS REFERENCE TO RELATED APPLICATION

This application claims the benefit of U.S. Provisional Application No. 61/038,639 filed on Mar. 21, 2008 which application is incorporated herein by reference in its entirety.

BACKGROUND OF THE INVENTION

1. Field of the Invention

The present invention relates to a gaming machine and a playing method thereof.

2. Description of Related Art

Conventionally, a gaming machine, which uses a coin or the like as a game value for a slot machine, a roulette game machine, a card game machine or the like, is capable of starting a predetermined game upon player's insertion of a coin into the gaming machine. When the player wins the game, a predetermined number of coins are paid out. Generally, in the above-mentioned gaming machine, a plurality of kinds of games are performed in order to avoid monotony. For example, when a predetermined condition is satisfied in a first game which is a base game, the first game is followed by a second game which is a so-called bonus game. Conventional gaming machines of this type are disclosed in specifications of U.S. Pat. Nos. 5,820,459, 4,283,709, and 6,003,013, for example. In these gaming machines, gaming terminals independently perform a first game, and a payout is awarded based on performance of the game. Various jackpots such as progressive jackpots, mystery jackpots and the like are provided as a second game.

However, in the above-described gaming machines which perform a game including the first and second games, in the second game, just a payout awarded upon a win is accumulated and shared with other players, but game contents are not shared.

An object of the present invention is to provide a gaming machine with entertainmentness unobtainable from the above-described prior art, and a playing method thereof. More specifically, an object of the present invention is to provide a gaming machine which extracts a player who can participate in a side-bet game. Game results (game contents) of a first game of players who will participate in a side-bet game are shared and used to perform a second game, and a payout of the second game is awarded to players who participate in the second game. This allows a player playing the game to enjoy the second game while feeling some togetherness (unity) with other players playing on neighboring terminal devices.

SUMMARY OF THE INVENTION

The present invention provides a gaming machine comprising: a common display which arranges a plurality of symbols in a matrix of arrangement areas; a plurality of terminal devices each having a terminal display which arranges a plurality of symbols in a matrix of arrangement areas and each having a side-bet device which selects to or not to participate in a game occurring on the common display, the terminal device rearranging the plurality of symbols in the arrangement areas on the terminal display and running a game to award a base payout in accordance with a relation among the rearranged symbols; and a controller which is programmed to operate in the steps of: (a1) extracting a predetermined number of terminal devices from the plurality of terminal devices; (a2) bringing side-bet devices of the extracted terminal devices into a selectable state; (a3) repeating the steps (a1) to (a2) until the number of terminal devices having selected to participate in a game occurring on the common display reaches a predetermined value; (a4) rearranging, on the common display, predetermined symbols among the symbols rearranged in the predetermined number of terminal devices selected by the side-bet devices; and (a5) awarding a bonus payout to the terminal devices having selected to participate in the game occurring on the common display, in accordance with a relation among the predetermined symbols rearranged on the common display.

According to the above structure, it is possible to extract a predetermined number of terminal devices from the plurality of terminal devices and bring the side-bet devices of the extracted terminal devices into a selectable state. As a result, by lottery, a player is given a chance of participating in a game occurring on the common display. This may allow the player to enjoy the game occurring on the common display in addition to the game occurring on the terminal device. Moreover, predetermined symbols among the symbols rearranged in the predetermined number of terminal devices selected by the side-bet devices are rearranged on the common display, and the bonus payout is awarded to the terminal devices having selected to participate in the game occurring on the common display, in accordance with a relation among the predetermined symbols rearranged on the common display. As a result, the bonus payout of the game occurring on the common display, which will be awarded to a player playing on the terminal device having made the side-bet, depends on game results of players playing on neighboring terminal devices. This may allow a player making a side-bet to enjoy the game while feeling some togetherness (unity) with players playing on the neighboring terminal devices.

In the above-mentioned gaming machine, the controller synchronizes, among the predetermined number of terminal devices selected by the side-bet devices, timing for rearranging the symbols in the terminal devices selected by the side-bet devices.

According to the above structure, it is possible to synchronize timing for rearranging symbols in the terminal devices selected by the side-bet devices, among a predetermined number of terminal devices selected by the side-bet devices. That is, symbols rearranged in the respective terminal devices are concurrently rearranged on the common display. As a result, players participating in the game occurring on the common display can recognize a result of the game at the same time. This may allow a player to enjoy the game while feeling some togetherness (unity) with players playing on the neighboring terminal devices.

The present invention provides a gaming machine comprising: a common display which arranges a plurality of symbols in a matrix of arrangement areas; a plurality of terminal devices each having a terminal display which arranges a plurality of symbols in a matrix of arrangement areas and each having a side-bet device which selects to or not to participate in a game occurring on the common display, the terminal device rearranging the plurality of symbols in the arrangement areas on the terminal display and running a game to award a base payout in accordance with a relation among the rearranged symbols; and a controller which is programmed to operate in the steps of: (b1) extracting a predetermined number of terminal devices from the plurality of terminal devices; (b2) bringing side-bet devices of the extracted terminal devices into a selectable state; (b3) repeating the steps (b1) to (b2) until the number of terminal devices having selected to participate in a game occurring on the common display reaches a predetermined value; (b4) extracting symbols, on a line or column basis, from the symbols rearranged in the matrixes of arrangement areas of the predetermined number of terminal devices selected by the side-bet devices; (b5) rearranging, on the common display, a combination of the symbols extracted on a line or column basis in the predetermined number of terminal devices selected by the side-bet device; and (b6) awarding a bonus payout to the terminal devices having selected to participate in the game occurring on the common display, in accordance with a relation among the symbols rearranged on the common display.

According to the above structure, it is possible to: extract symbols, on a line or column basis, from the symbols rearranged in the matrixes of arrangement areas of the predetermined number of terminal devices selected by the side-bet devices; rearrange, on the common display, a combination of the symbols extracted on a line or column basis in the predetermined number of terminal devices selected by the side-bet devices; and award a bonus payout to the terminal devices having selected to participate in the game occurring on the common display, in accordance with a relation among the symbols rearranged on the common display. Accordingly, a result of the game occurring on the common display depends on lines or columns of symbols rearranged in the surrounding terminal devices. This may allow a player to enjoy the game while feeling some togetherness (unity) with other players playing on the neighboring terminal devices.

In the above-mentioned gaming machine, the controller synchronizes, among the predetermined number of terminal devices selected by the side-bet devices, timing for rearranging the symbols in the matrixes of arrangement areas of the terminal devices selected by the side-bet devices.

According to the above structure, it is possible to synchronize timing for rearranging symbols in the terminal devices selected by the side-bet devices, among a predetermined number of terminal devices selected by the side-bet devices. That is, the lines or columns of symbols rearranged in the respective terminal devices are concurrently rearranged on the common display. As a result, players participating in the game occurring on the common display can recognize a result of the game at the same time. This may allow a player to enjoy the game while feeling some togetherness (unity) with players playing on the neighboring terminal devices.

In the above-mentioned gaming machine, in the step (b1), the predetermined number of terminal devices extracted from the plurality of terminal devices is equal to the number of lines or columns constituting the matrix of arrangement areas of the common display.

According to the above structure, it is possible to make the number of terminal devices extracted from the plurality of terminal devices agree with the number of lines or columns constituting the matrix of arrangement areas on the common display. As a result, a player who has selected to participate in a game occurring on the common display can have his/her game result on the terminal device surely reflected in the game occurring on the common display. This may allow a player to further enjoy the game while feeling some togetherness (unity) with other players playing on the neighboring terminal devices.

In the above-mentioned gaming machine, in the step (b1), the predetermined number of terminal devices extracted from the plurality of terminal devices is equal to the number of lines or columns constituting the matrix of arrangement areas of the common display; and the controller synchronizes, among the terminal devices selected by the side-bet devices, timing for rearranging the symbols in the matrixes of arrangement areas of the terminal devices selected by the side-bet devices.

According to the above structure, it is possible to: make the number of terminal devices extracted from the plurality of terminal devices agree with the number of lines or columns constituting the matrix of arrangement areas on the common display; and synchronize timing for rearranging symbols in the matrix of arrangement areas in the terminal devices selected by the side-bet devices, among the terminal devices selected by the side-bet devices. As a result, players who have selected to participate in a game occurring on the common display can have their game results on the terminal devices concurrently reflected in the game occurring on the common display. This may allow a player to still further enjoy the game while feeling some togetherness (unity) with other players playing on the neighboring terminal devices.

The present invention provides a playing method of a gaming machine comprising: a common display which arranges a plurality of symbols in a matrix of arrangement areas; and a plurality of terminal devices each having a terminal display which arranges a plurality of symbols in a matrix of arrangement areas and each having a side-bet device which selects to or not to participate in a game occurring on the common display, the terminal device rearranging the plurality of symbols in the arrangement areas on the terminal display and running a game to award a base payout in accordance with a relation among the rearranged symbols, the method including the steps of: (1) extracting a predetermined number of terminal devices from the plurality of terminal devices; (2) bringing side-bet devices of the extracted terminal devices into a selectable state; (3) repeating the steps (1) to (2) until the number of terminal devices having selected to participate in a game occurring on the common display reaches a predetermined value; (4) rearranging, on the common display, predetermined symbols among the symbols rearranged in the predetermined number of terminal devices selected by the side-bet devices; and (5) awarding a bonus payout to the terminal devices having selected to participate in the game occurring on the common display, in accordance with a relation among the predetermined symbols rearranged on the common display.

According to the above-mentioned playing method, it is possible to extract a predetermined number of terminal devices from the plurality of terminal devices and bring the side-bet devices of the extracted terminal devices into a selectable state. As a result, by lottery, a player is given a chance of participating in a game occurring on the common display. This may allow the player to enjoy the game occurring on the common display in addition to the game occurring on the terminal device. Moreover, predetermined symbols among the symbols rearranged in the predetermined number of terminal devices selected by the side-bet devices are rearranged on the common display, and the bonus payout is awarded to the terminal devices having selected to participate in the game occurring on the common display, in accordance with a relation among the predetermined symbols rearranged on the common display. As a result, the bonus payout of the game occurring on the common display, which will be awarded to a player playing on the terminal device having made the side-bet, depends on game results of players playing on neighboring terminal devices. This may allow a player making a side-bet to enjoy the game while feeling some togetherness (unity) with players playing on the neighboring terminal devices.

BRIEF DESCRIPTION OF THE DRAWINGS

FIG. 7 shows symbol columns and code numbers of respective symbols;

FIG. 10 is an explanatory view showing a base game winning combination lottery table;

FIG. 11 is an explanatory view showing a base game payout table;

FIG. 12 is an explanatory view showing a side-bet game payout table;

DESCRIPTION OF THE PREFERRED EMBODIMENTS

An embodiment of a gaming machine and a playing method thereof according to the present invention will be described.

Figure 1:
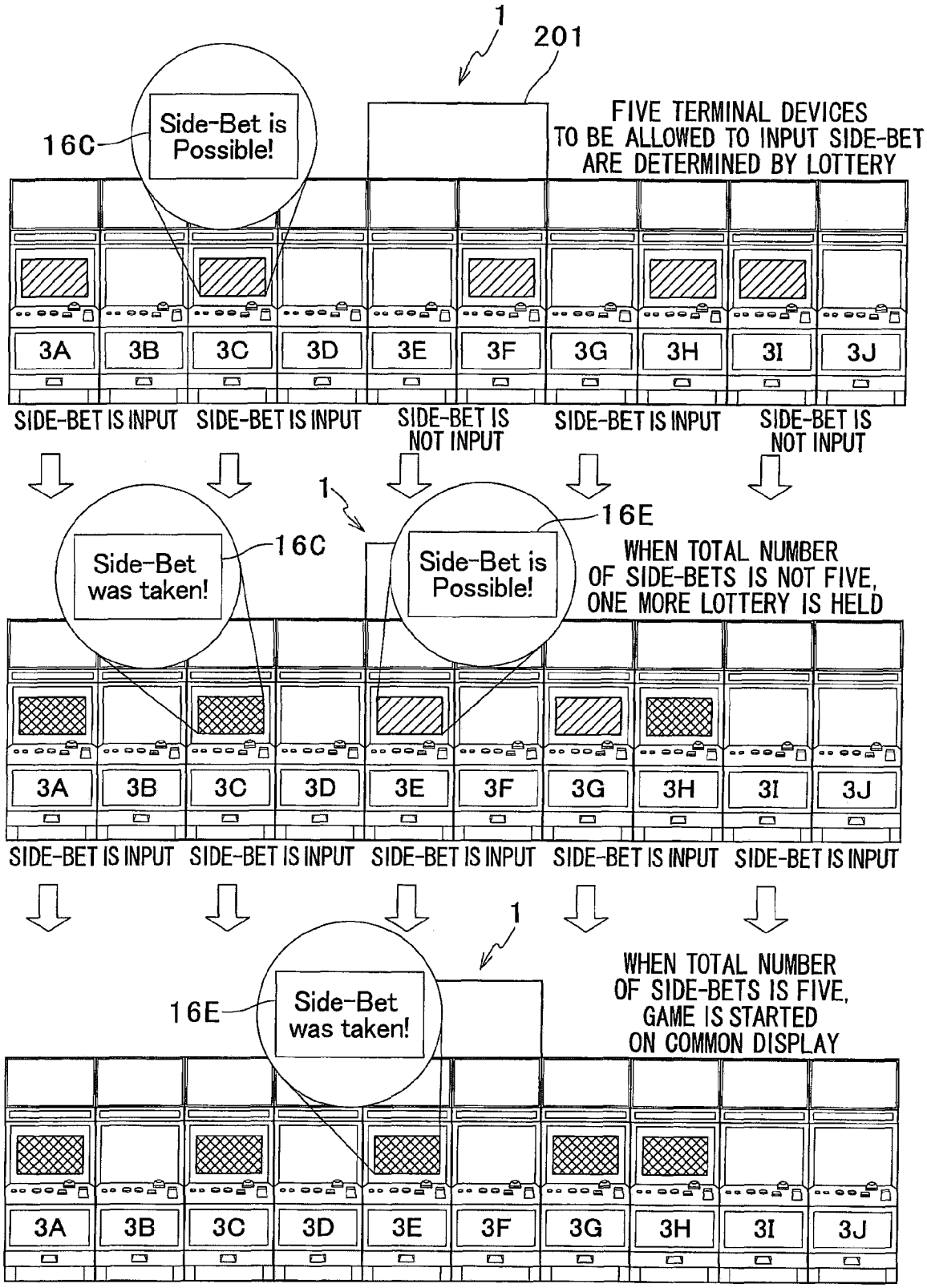
FIG. 1 is an explanatory view showing a playing method of a gaming machine.

As shown in FIG. 1, the present invention is embodied as a playing method of a gaming machine including: a common display which arranges a plurality of symbols in a matrix of arrangement areas; a plurality of terminal devices each having a terminal display which arranges a plurality of symbols in a matrix of arrangement areas and each having a side-bet device which selects to or not to participate in a game occurring on the common display, the terminal device rearranging the plurality of symbols in the arrangement areas on the terminal display and running a game to award a base payout in accordance with a relation among the rearranged symbols; and a controller. The playing method includes the steps of: extracting a predetermined number of terminal devices from the plurality of terminal devices; bringing side-bet devices of the extracted terminal devices into a selectable state; repeating the above steps until the number of terminal devices having selected to participate in a game occurring on the common display reaches a predetermined value; extracting symbols, on a line or column basis, from the symbols rearranged in the matrixes of arrangement areas of the predetermined number of terminal devices selected by the side-bet devices; rearranging, on the common display, a combination of the symbols extracted on a line or column basis in the predetermined number of terminal devices selected by the side-bet device; and awarding a bonus payout to the terminal devices having selected to participate in the game occurring on the common display, in accordance with a relation among the symbols rearranged on the common display.

In this embodiment, the "side-bet game" is a sideshow game which is played independently of a main plot of a base game.

Figure 2:
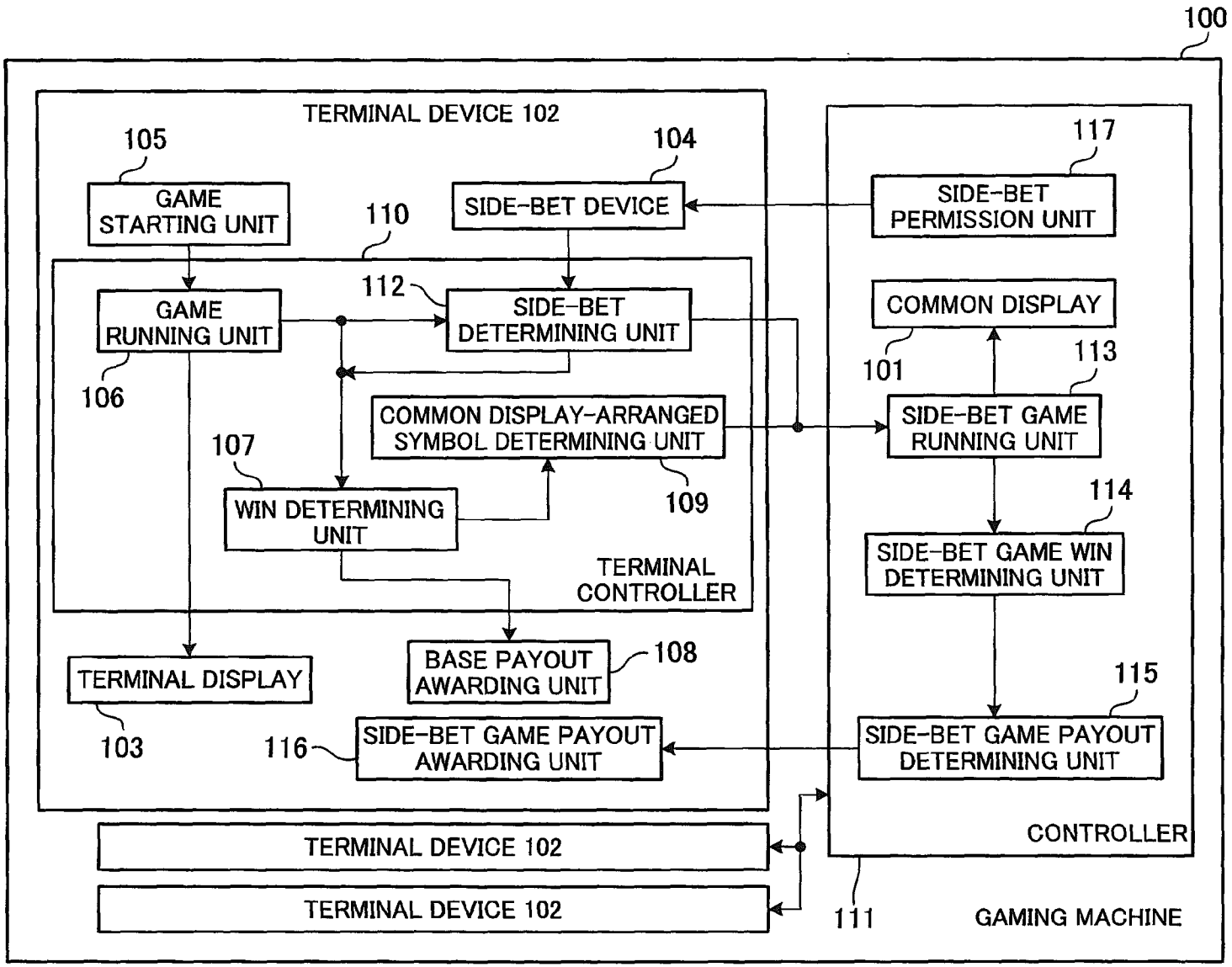
FIG. 2 is a block diagram of the gaming machine.

A gaming machine 100 which runs the above game includes a controller 111 and a plurality of terminal devices 102, as shown in FIG. 2.

The controller 111 has a side-bet game running unit 113, a side-bet game win determining unit 114, a side-bet game payout determining unit 115, a common display 101, and a side-bet permission unit 117. The common display 101 is adapted to arrange a plurality of symbols 180. The terminal device 102 has a game starting unit 105, a side-bet device 104, a terminal controller 110, a terminal display 103, a base payout awarding unit 108, and a side-bet game payout awarding unit 116.

In addition, the terminal controller 110 has a game running unit 106, a side-bet determining unit 112, a common display-arranged symbol determining unit 109, and a win determining unit 107.

Here, "arranging" means making a state where symbols 180 are visible to a player. For example, in FIG. 1, it means making a state where symbols 180 are displayed in display windows 151 to 155. Arranging symbols 180 again after dismissing symbols 180 is called "rearranging".

The common display 101 and the terminal display 103 may have a mechanical structure adopting a reel device which rotates a reel to arrange symbols 180. Alternatively, the common display 101 and the terminal display 103 may have an electrical structure in which a video reel is displayed as an image to thereby arrange symbols 180. Further, a combination of the mechanical structure (reel) and the electric structure (video reel) may also be possible. Examples of the electrical structure include a liquid crystal display device, a CRT (cathode-ray tube), a plasma display device, and the like. A specific structure of the common display 101 and the terminal display 103 will be detailed later.

[Controller 111 and Terminal Controller 110]

The controller 111 and the terminal controller 110 performs: a first process of extracting a predetermined number of terminal devices from the plurality of terminal devices; a second process of bringing side-bet devices of the extracted terminal devices into a selectable state; a third process of repeating the above processes until the number of terminal devices having selected to participate in a game occurring on the common display reaches a predetermined value; a fourth process of extracting symbols, on a line or column basis, from the symbols rearranged in the matrixes of arrangement areas of the predetermined number of terminal devices selected by the side-bet devices; a fifth process of rearranging, on the common display, a combination of the symbols extracted on a line or column basis in the predetermined number of terminal devices selected by the side-bet device; and a sixth process of awarding a bonus payout to the terminal devices having selected to participate in the game occurring on the common display, in accordance with a relation among the symbols rearranged on the common display. In other words, the controller 111 and the terminal controller 110 include six process stages.

[Operations of Controller 111 and Terminal Controller 110]

A description will be given of operations of the controller 111 and the terminal controller 110 having the above-described structure. First, the side-bet permission unit 117 extracts a predetermined number of terminal devices 102 from the terminal devices 102. That is, the controller 111 performs the first process.

Then, side-bet devices 104 of the terminal devices 102 extracted by the side-bet permission unit 117 are brought into a selectable state. That is, the terminal controller 110 performs the second process.

The first and second processes are repeated until the number of terminal devices 102 selected by the side-bet devices 104 reaches a predetermined value. That is, the controller 111 and the terminal controller 110 perform the third process.

Then, after a game value is inserted, triggered by a game start signal from the game starting unit 105, the game running unit 106 starts variably displaying the symbols 180 having been arranged on the terminal display 103. Then, the win determining unit 107 causes the base payout awarding unit 108 to award a base payout in accordance with a relation among the symbols 180 thus rearranged.

Then, the side-bet determining unit 112 determines whether the side-bet device 104 has selected to participate in a side-bet game or not. When it is determined that the side-bet device 104 has selected to participate in a side-bet game, the common display-arranged symbol determining unit 109 randomly extracts, on a line or column basis, symbols 180 to be arranged on the common display 101, from the symbols 180 rearranged on the terminal display 103. That is, the terminal controller 110 performs the fourth process.

Then, the side-bet game running unit 113 combines the symbols thus extracted on a line or column basis with each other, and rearranges them on the common display 101. That is, the controller 111 and the terminal controller 110 perform the fifth process.

Then, the side-bet game win determining unit 114 detects the rearranged symbols 180. The side-bet game payout determining unit 115 calculates a payout to be awarded to the terminal devices 102 having participated in the side-bet game, in accordance with a relation among the symbols 180 detected. The side-bet game payout awarding unit 116 awards the payout to the terminal devices 102 having participated in the side-bet game. That is, the controller 111 and the terminal controller 110 perform the sixth process.

Each block of the controller 111 and the terminal controller 110 may be formed by hardware or by software as needed.

As seen from the above-described operations, the present invention is embodied as a playing method of a gaming machine 100 including: a common display 101 which arranges a plurality of symbols 180 in a matrix of arrangement areas; a plurality of terminal devices 102 each having a terminal display 103 which arranges a plurality of symbols 180 in a matrix of arrangement areas and each having a side-bet device 104 which selects to or not to participate in a game occurring on the common display 101, the terminal device 102 rearranging the plurality of symbols 180 in the arrangement areas on the terminal display 103 and running a game to award a base payout in accordance with a relation among the rearranged symbols 180; and a controller 111 and a terminal controller 110. The playing method includes the steps of: extracting a predetermined number of terminal devices 102 from the plurality of terminal devices 102; bringing side-bet devices 104 of the extracted terminal devices 102 into a selectable state; repeating the above steps until the number of terminal devices 102 having selected to participate in a game occurring on the common display 101 reaches a predetermined value; extracting symbols, on a line or column basis, from the symbols 180 rearranged in the matrixes of arrangement areas of the predetermined number of terminal devices 102 selected by the side-bet devices 104; rearranging, on the common display 101, a combination of the symbols 180 extracted on a line or column basis in the predetermined number of terminal devices 102 selected by the side-bet device 104; and awarding a bonus payout to the terminal devices 102 having selected to participate in the game occurring on the common display 101, in accordance with a relation among the symbols 180 rearranged on the common display 101.

In the above-mentioned structure, it is possible to: extract symbols 180, on a line or column basis, from the symbols 180 rearranged in the matrixes of arrangement areas of the predetermined number of terminal devices 102 selected by the side-bet devices 104; rearrange, on the common display 101, a combination of the symbols 180 extracted on a line or column basis in the predetermined number of terminal devices 102 selected by the side-bet devices 104; and award a bonus payout to the terminal devices 102 having selected to participate in the game occurring on the common display 101, in accordance with a relation among the symbols 180 rearranged on the common display 101. Accordingly, a result of the game occurring on the common display 101 depends on lines or columns of symbols rearranged in the surrounding terminal devices 102. This may allow a player to enjoy the game while feeling some togetherness (unity) with other players playing on the neighboring terminal devices 102.

Embodiment

[Mechanical Structure of Gaming Machine 1]

The following describes an embodiment where the gaming machine 100 having the above-described structure is applied to a gaming machine 1 and specifically structured in mechanical, electrical, and operational senses.

The gaming machine 1 is placed in a gaming facility or the like. The gaming machine 1 performs a unit game by use of a game value. The game value is a coin, a bill, or a value in the form of electronic information. However, the game value in the present invention is not particularly limited. For example, a medal, token, electronic money, a ticket and the like are also possible. Further, the ticket is not particularly limited and may be a barcoded ticket which will be described later, and the like.

Figure 3:
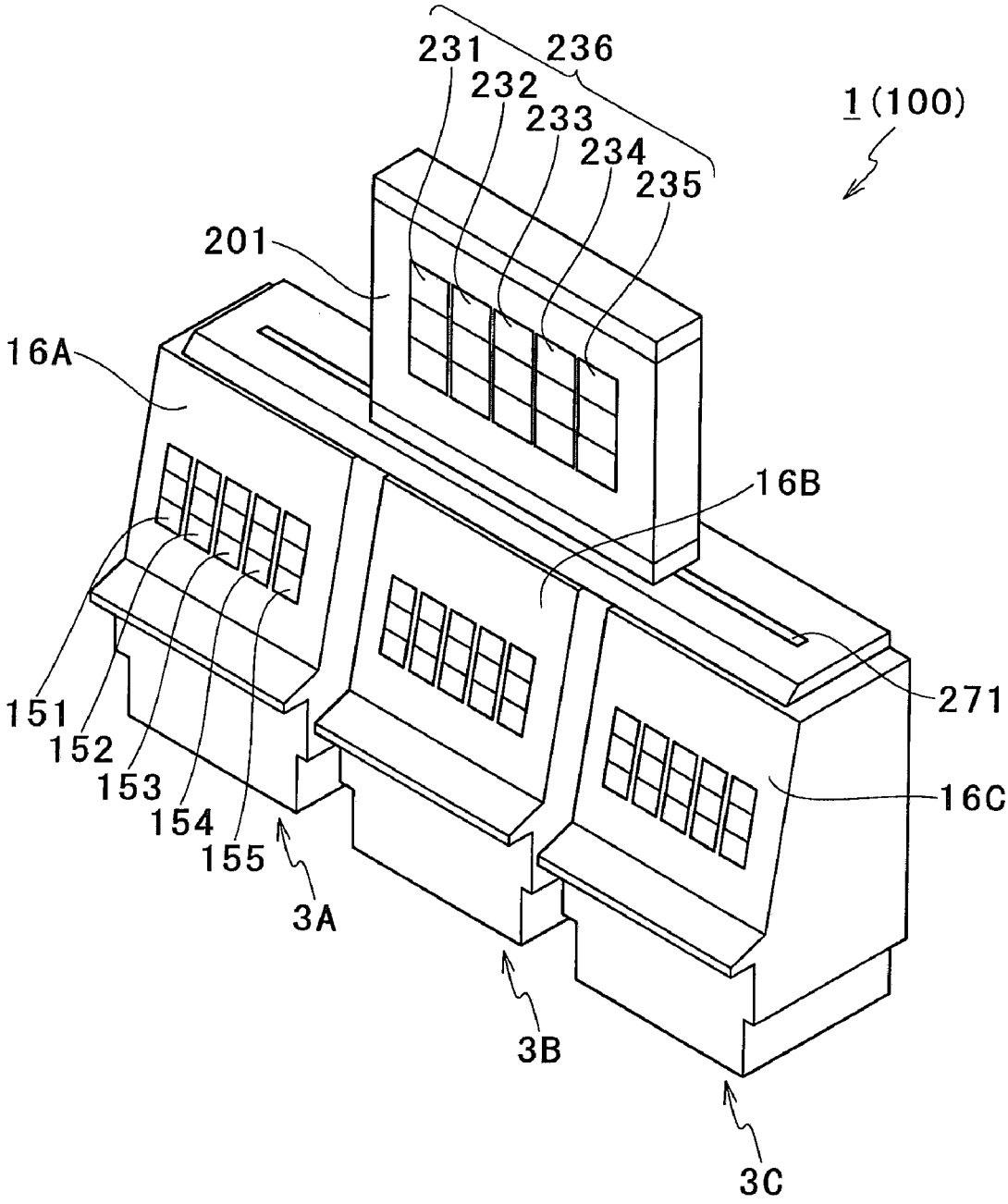
FIG. 3 is a perspective view showing external appearance of a gaming machine.

As shown in FIGS. 1 and 3, the gaming machine 1 is connected in communication with terminal devices 3A to 3J which run games independently of one another. The gaming machine 1 has a common display 201 which displays an image relating to a shared game, a rail 271 which moves the common display 201 to just above each of the terminal devices 3A to 3J, and a not-shown drive motor 270. The common display 201, which serves as a common display to arrange symbols 180, corresponds to the common display 101 shown in FIG. 2.

Figure 4:
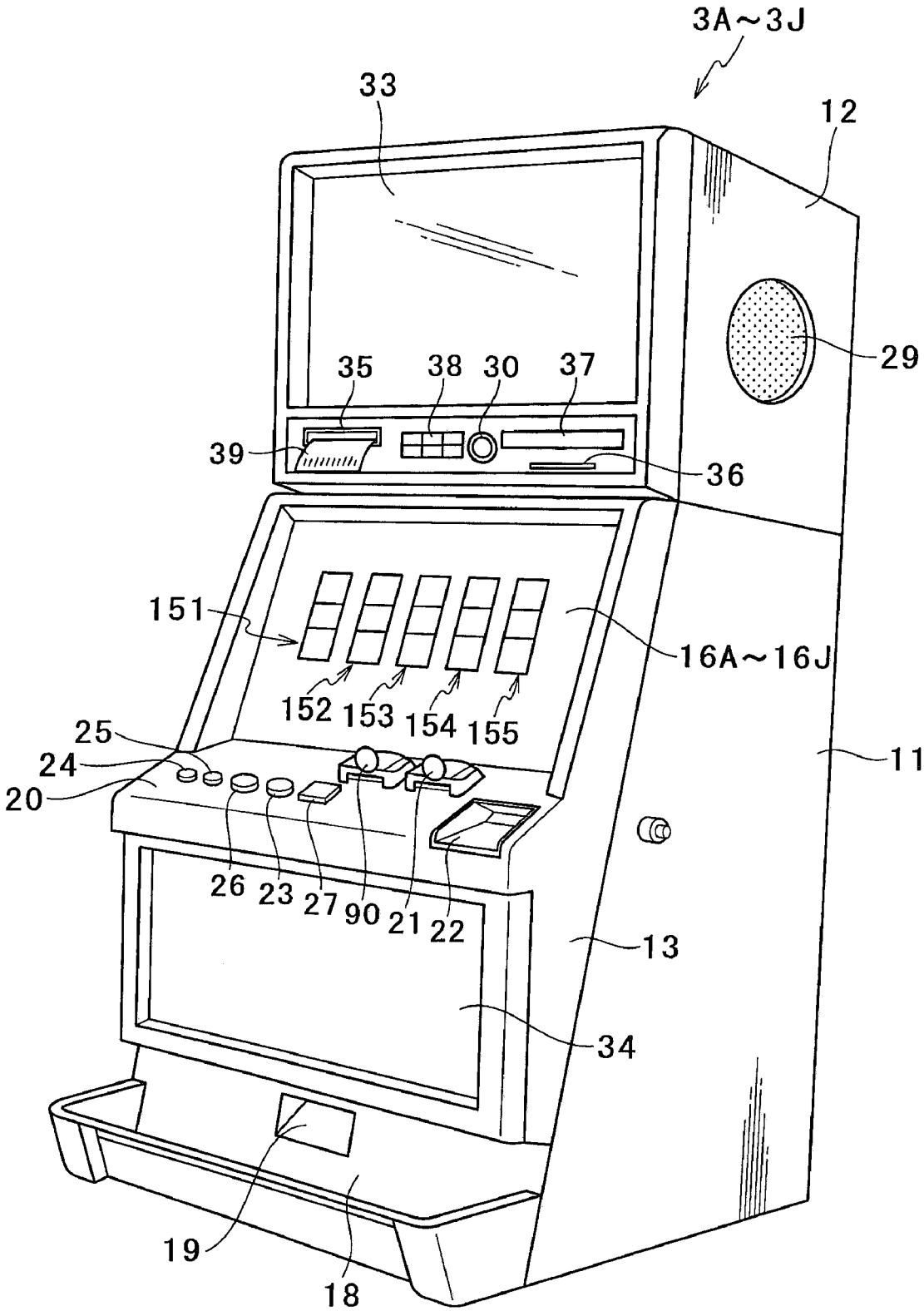
FIG. 4 is a perspective view showing an external appearance of a terminal device.

As shown in FIG. 4, each of the terminal devices 3A to 3J has a cabinet 11, a top box 12 placed on an upper side of the cabinet 11, and a main door 13 provided on a front surface of the cabinet 11. Each of lower image display panels 16A to 16J is provided on the main door 13. Each of the lower image display panels 16A to 16J has a transparent liquid crystal panel which displays various information. Each of the lower image display panels 16A to 16J displays display windows 151 to 155 (a matrix 156) where a plurality of symbols 180 are arranged, and in addition displays as needed game-related various information, effect images, and the like. The common display 201 has the same structure. The terminal devices 3A to 3J correspond to the terminal devices 102 shown in FIG. 2. The matrix 156 with five columns and three rows in the display windows 151 to 155 correspond to the matrix of arrangement areas. Each of the lower image display panels 16A to 16J serving as a terminal display corresponds to the terminal display 103 shown in FIG. 2.

This embodiment deals with, as an example, a case where the lower image display panels 16A to 16J electrically display symbols 180 to thereby display five columns and three rows of symbols. However, the present invention is not limited thereto. For example, three columns and three rows of symbols, or five columns and five rows of symbols, may be acceptable.

In this example, symbols 180 arranged in the display windows 151 to 155 are scatter symbols. Here, scatter symbols mean such symbols that activation occurs (i.e., a payout is awarded, a bonus game is given, or the like) when a predetermined number of them stop in the matrix of arrangement areas made up of the five columns and three rows of the display windows 151 to 155. For example, in a base game where scatter symbols are adopted, a payout is awarded when a predetermined number (e.g., five or more) of scatter symbols are displayed in the display windows 151 to 155 (fifteen arrangement regions). That is, when a predetermined number of scatter symbols are displayed in the display windows 151 to 155, a payout is awarded regardless of display positions or an arrangement way of the scatter symbols.

Note that each of the lower image display panels 16A to 16J may have a credit value indicator and a payout value indicator. The credit value indicator displays a total value (hereinafter also referred to as total credit value) which each of the terminal devices 3A to 3J can pay out to a player. The payout value indicator displays the number of coins to be paid out.

Below the lower image display panels 16A to 16J provided are a control panel 20, a coin receiving slot 21, a side-bet coin receiving slot 90, and a bill validator 22. The control panel 20 is provided with buttons 23 to 27. These buttons 23 to 27 allow a player to input commands relating to a game progress. The coin receiving slot 21 and the side-bet coin receiving slot 90 enable coins to be received into the cabinet 11. The side-bet coin receiving slot 90 corresponds to the side-bet device 104 shown in FIG. 2.

The control panel 20 includes a spin button 23, a change button 24, a cashout button 25, a 1-BET button 26, and a maximum BET button 27. The spin button 23 is for inputting a command to start scrolling the symbols 180. The change button 24 is used to ask a staff person of the gaming facility for money exchange. The cashout button 25 is for inputting a command to pay out coins corresponding to the total credit-value into the coin tray 18. The control panel 20 which performs a game in the terminal device corresponds to the game starting unit 105 shown in FIG. 2.

The 1-BET button 26 is for inputting a command to bet, on a game, one coins among coins corresponding to the total credit value. The maximum BET button 27 is for inputting a command to bet, on a game, a maximum number of coins bet-table on one game (e.g., fifty coins) among coins corresponding to the total credit value.

The bill validator 22 validates whether a bill is genuine or not and receives the genuine bill into the cabinet 11. Note that the bill validator 22 is capable of reading a barcoded ticket 39 which will be described later. When the bill validator 22 reads the barcoded ticket 39, it outputs to the main CPU 41 a read signal relating to what has been read.

On a front surface of a lower part of the main door 13, that is, below the control panel 20, a belly glass 34 is provided. On the belly glass 34, a character of the terminal devices 3A to 3J, or the like is drawn. On a front surface of the top box 12 is provided an upper image display panel 33. The upper image display panel 33 has a liquid crystal panel, and displays an effect image, an image representing game introduction or game rules, or the like.

Further, the top box 12 has a lamp 30 for presenting an effect, and a speaker 29 for performing an audio output. Below the upper image display panel 33 are provided a ticket printer 35, a card reader 36, a data displayer 37, and a keypad 38. The ticket printer 35 prints, on to a ticket, a barcode which is an encoded form of data such as a credit-value, time and date, identification number of the terminal device 3A to 3J, and the like. Thereby, the ticket printer 35 issues a barcoded ticket 39. A player can play a game in other gaming terminals 3A to 3J with the barcoded ticket 39, or exchange the barcoded ticket 39 with bill at a change booth of the game arcade.

The card reader 36 reads and writes data from and into a smart card. The smart card is carried by a player, and stores therein data for identifying the player and data relating to a history of games played by the player, for example.

The data displayer 37 includes a fluorescent display or the like, and displays the data read by the card reader 36 and the data input by the player through the keypad 38, for example. The keypad 38 is for entering commands or data relating to issuing of a ticket.

[Electrical Structure of Gaming Machine]

Figure 8:
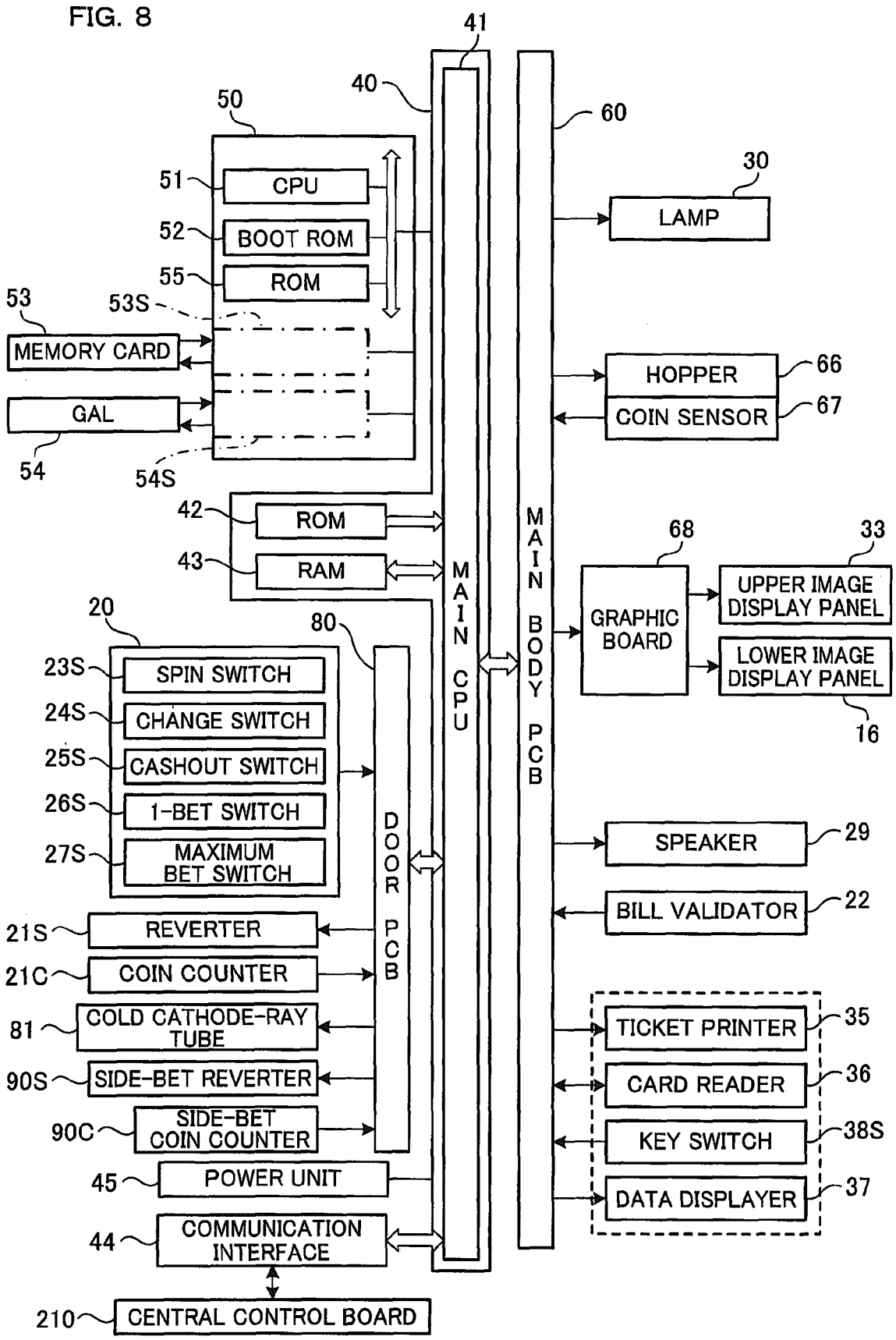
FIG. 8 is a block diagram showing an electrical structure of the terminal device.
Figure 9:
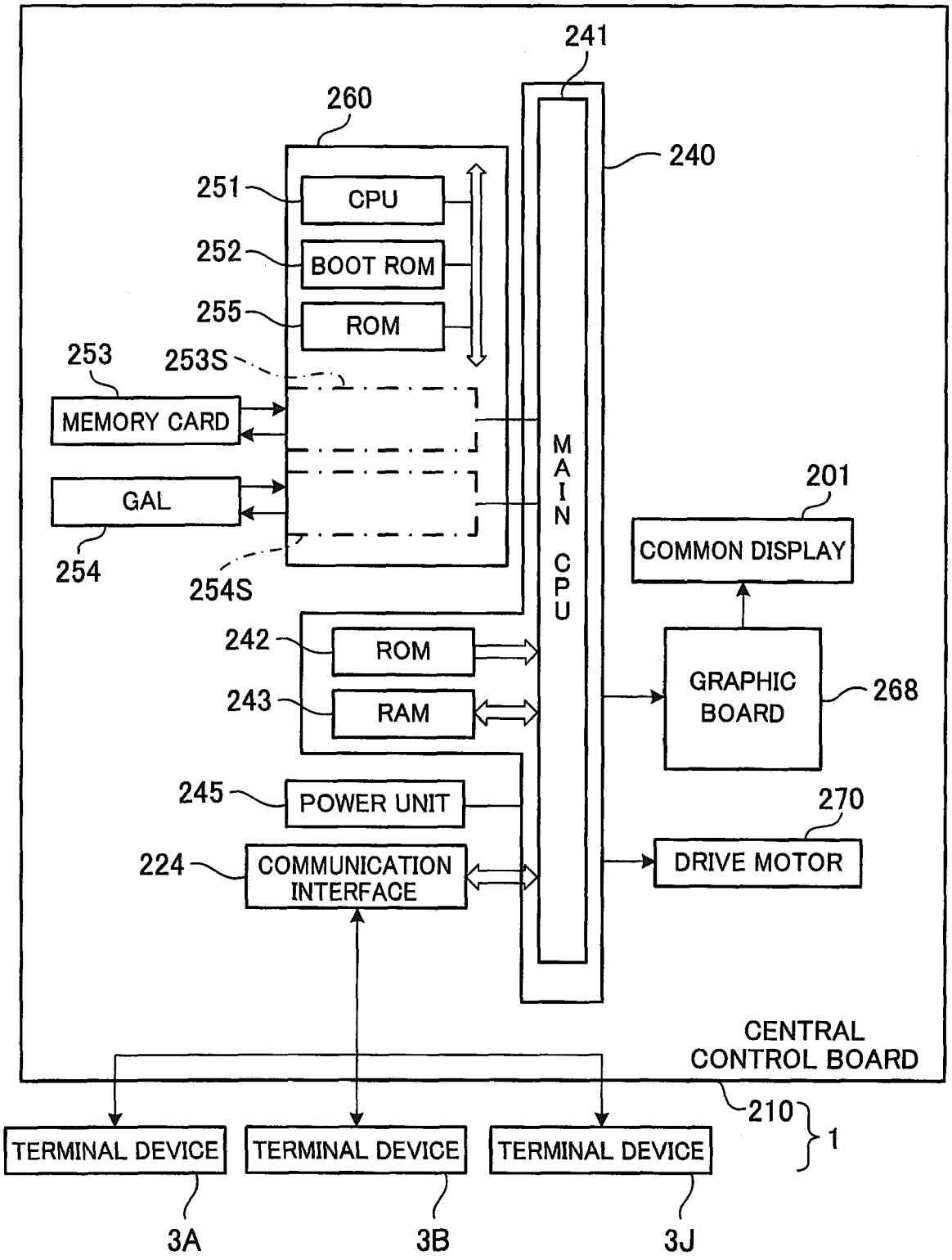
FIG. 9 is a block diagram showing an electrical structure of a central control board.

FIGS. 8 and 9 are block diagrams each illustrating an electrical structure of the entire gaming machine 1.

[Electrical Structure of Terminal Device]

FIG. 8 is a block diagram showing an electrical structure of the terminal device 3A to 3J. As illustrated in FIG. 8, a control unit is provided within the cabinet 11. The control unit includes a motherboard 40, a main body PCB (Printed Circuit Board) 60, a gaming board 50, a door PCB 80, various switches, sensors, or the like.

The gaming board 50 has a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code numbers corresponding to the symbols) to be stopped on the matrix 156.

This stop symbol determining program contains sets of symbol weighting data respectively corresponding to various payout rates (e.g., 80%, 84% and 88%). Each set of the symbol weighting data indicates, for each of the display windows 151 to 155, correspondence between a code number of each symbol column (symbol lines A to E) and at least one random numerical value belonging to a predetermined range. The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores data indicating correspondence between each of symbols 180 displayed in the display windows 151 to 155 and a range of a random numerical values, in the form of a base game winning combination lottery table 130 (see FIG. 10). The memory card 53 also stores payout data which are based on a lottery result obtained from the base game winning combination lottery table 130, in the form of a base game payout table 131 (see FIG. 11). These data are transferred to a RAM 43 of the motherboard 40, at the time of running a game program.

The card slot 53S is structured so as to allow the memory card 53 to be attached and detached to and from the card slot 53S. This card slot 53S is connected to the motherboard 40 through an IDE bus. Thus, a type and contents of a game run by the terminal device 3A to 3J can be changed by detaching the memory card 53 from the card slot 53S, writing a different game program and a different game system program into the memory card 53, and inserting the memory card 53 back into the card slot 53S.

The game programs include a program relating to a game progress. The game programs also include data of images and sounds to be outputted during a game.

The GAL 54 has input and output ports. When the GAL 54 receives data via the input port, it outputs, from its output port, data corresponding to the input data.

The IC socket 54S is structured so as to allow the GAL 54 to be attached and detached to and from the IC socket 54S. The IC socket 54S is connected to the motherboard 40, via a PCI bus. Thus, data to be output from the GAL 54 can be changed by detaching the GAL 54 from the IC socket 54S, overwriting the program stored in the GAL 54, and then attaching the GAL 54 back to the IC socket 54S.

The CPU 51, the ROM 55, and the boot ROM 52 connected to one another through the internal bus are connected to the motherboard 40 through a PCI bus. The PCI bus communicates signals between the motherboard 40 and the gaming board 50, and supplies power from the motherboard 40 to the gaming board 50. The ROM 55 stores country identification information and an authentication program. The boot ROM 52 stores a preliminary authentication program, a program (boot code) for enabling the CPU 51 to run the preliminary authentication program, and the like.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified, that is, for authenticating the authentication program.

The motherboard 40 has a main CPU 41, a ROM (Read Only Memory) 42, a RAM (Random Access Memory) 43, and a communication interface 44. The motherboard 40 acting as a controller corresponds to the terminal controller 110 shown in FIG. 2.

The main CPU 41 controls the entire terminal device 3A to 3J. In particular, the main CPU 41 controls the following operations of: outputting a command signal for making the graphic board 68 variably display symbols 180, at a time when the spin button 23 is pressed after betting of credit; determining symbols 180 to be stopped after the variable-displaying of symbols 180; and stopping the symbols 180 thus determined in the display windows 151 to 155. The main CPU 41 corresponds to the game running unit 106, the common display-arranged symbol determining unit 109, the win determining unit 107, and the side-bet determining unit 112 shown in FIG. 2.

In other words, the main CPU 41 serves to control arrangement, by scrolling symbols displayed in the lower image display panels 16A to 16J, then selecting and determining symbols to be rearranged from various kinds of symbols, to rearrange new symbols, and stopping scrolling of the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized, and the game program and the game system program stored in the memory card 53 are read out through the gaming board 50. The RAM 43 stores data or a program used for the main CPU 41 to perform a process. For example, the base game winning combination lottery table 130, the base game payout table 131, a game running processing program, and a side-bet processing program are stored in the RAM 43. In addition, a credit value is stored in the RAM 43.

The communication interface 44 communicates with a central control board 210 through a communication line. Further, a main body PCB (Printed Circuit Board) 60 and a door PCB 80 are connected to the motherboard 40, respectively through USBs (Universal Serial Buses). Further, a power unit 45 is connected to the motherboard 40. When the power unit 45 supplies power to the motherboard 40, the main CPU 41 of the mother board 40 is booted and in addition power is supplied to the gaming board 50 through the PCI bus so that the CPU 51 is booted.

Various devices or units which generate signals to be input to the main CPU 41, and various devices or units whose operations are controlled by signals output from the main CPU 41 are connected to the main body PCB 60 and the door PCB 80. Based on a signal input to the main CPU 41, the main CPU 41 runs the game program and the game system program stored in the RAM 43, to perform an arithmetic process. Then, the main CPU 41 stores a result of the arithmetic process in the RAM 43, or performs a control process on various devices and units by transmitting a control signal to the various devices and units.

A lamp 30, a hopper 66, a coin sensor 67, a graphic board 68, the speaker 29, a bill validator 22, a ticket printer 35, a card reader 36, a key switch 38S, and a data displayer 37 are connected to main body PCB 60.

The lamp 30 is turned on/off based on a control signal from the main CPU 41.

The hopper 66 is mounted within the cabinet 11 and pays out a predetermined number of coins through a coin outlet 19 into the coin tray 18, based on a control signal output from the main CPU 41. The coin sensor 67 is provided inside the coin outlet 19. When the coin sensor 67 senses that a predetermined number of coins have been delivered from the coin outlet 19, the coin sensor 67 outputs a signal to be input to the main CPU 41. The hopper 66 corresponds to the base payout awarding unit 108 and the side-bet game payout awarding unit 116 shown in FIG. 2.

The graphic board 68 controls image display on the upper image display panel 33 and the lower image display panel 16A to 16J, based on a control signal from the main CPU 41. Further, the graphic board 68 is provided with a VDP (Video Display Processor) for generating image data based on a control signal output from the main CPU 41, a video RAM for temporarily storing the image data generated by the VDP, and the like. Note that image data used at the time when the VDP generates the image data are included in the game program which has been read out from the memory card 53 and stored into the RAM 43.

The bill validator 22 reads an image on a bill and takes only one recognized to be genuine into the cabinet 11. When taking in a genuine bill, the bill validator 22 outputs, to the main CPU 41, an input signal based on a value of the bill. The main CPU 41 stores into the RAM 43 a credit value equivalent to the value of the bill indicated by the signal.

Based on a control signal output from the main CPU 41, the ticket printer 35 prints a barcode on a ticket, and outputs it as a barcoded ticket 39. The barcode contains encoded data of the credit value stored in the RAM 43, time and date, an identification number of the terminal device 3A to 3J, and the like.

The card reader 36 reads out data from the smart card and transmits the data to the main CPU 41. Further, the card reader 36 writes data into the smart card based on a control signal output from the main CPU 41. The key switch 38S is mounted to the keypad 38, and outputs a signal to the main CPU 41 in response to a player's operation on the keypad 38. The data displayer 37 displays, based on a control signal output from the main CPU 41, data read by the card reader 36 or data input by the player through the keypad 38.

A control panel 20, a reverter 21S, a coin counter 21C, a side-bet reverter 90S, a side-bet coin counter 90C, and a cold cathode tube 81 are connected to the door PCB 80. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a maximum BET switch 27S associated with the maximum BET button 27. Each of the switches 23S to 27S outputs a signal to the main CPU 41, when a player presses the associated button.

The coin counter 21C and the side-bet coin counter 90C are provided within the coin receiving slot 21 and the side-bet coin receiving slot 90, respectively, and identify whether coins inserted into the coin receiving slot 21 and the side-bet coin receiving slot 90 by the player are genuine. A coin other than a genuine coin is discharged from the coin outlet 19. The coin counter 21C and the side-bet coin counter 90C outputs an input signal to the main CPU 41 upon detection of a genuine coin. The side-bet coin counter 90C corresponds to the side-bet determining unit 112 shown in FIG. 2.

The reverter 21S and the side-bet reverter 90S are operated based on control signals output from the main CPU 41. The reverter 21S and the side-bet reverter 90S distribute coins, which the coin counter 21C and the side-bet coin counter 90C have recognized as genuine coins, to the hopper 66 or a cash box (not shown) mounted in the terminal device 3A to 3J. In other words, when the hopper 66 is full of coins, genuine coins are distributed into the cash box by the reverter 21S and the side-bet reverter 90S. On the other hand, when the hopper 66 is not yet full of coins, genuine coins are distributed into the hopper 66. The cold cathode tube 81 functions as a backlight mounted on rear sides of the lower image display panel 16A to 16J and the upper image display panel 33. The cold cathode tube 81 turns on based on a control signal output from the main CPU 41.

[Base Game Winning Combination Lottery Table]

A base game winning combination lottery table 130 which is used in a game running process executed by the terminal device 3A to 3J will be described with reference to FIG. 10. FIG. 10 is an explanatory view showing a base game winning combination lottery table. The base game winning combination lottery table 130 is stored in the RAM 43, and read during a symbol determining process of the game running process which will be described later.

As shown in FIG. 10, random numerical values used in the base game winning combination lottery table 130 ranges from 0 to 5998. When a random numerical value sampled by the main CPU 41 is 0 to 29, a winning combination of "SUN" 181 is made, and five symbols 180 presenting "SUN" 181 are stopped in the display windows 151 to 155. When a random numerical value sampled by the main CPU 41 is 30 to 51, a winning combination of "HEART" 182 is made, and five symbols 180 presenting "HEART" 182 are stopped in the display windows 151 to 155. When a random numerical value sampled by the main CPU 41 is 52 to 107, a winning combination of "MOON" 183 is made, and five symbols 180 of "MOON" 183 are stopped in the display windows 151 to 155. Likewise, when a random numerical value is 108 to 207, a winning combination of "K" 186 is made. When a random numerical value is 208 to 407, a winning combination of "A" 184 is made. When a random numerical value is 408 to 807, a winning combination of "Q" 187 is made. When a random numerical value is 808 to 1477, a winning combination of "J" 185 is made. When a random numerical value is 1478 to 1807, a winning combination of "10" 188 is made. When a random numerical value sampled by the main CPU 41 is 1808 to 5998, it means a loss, and a losing combination of symbols 180, which is different from any of the above-mentioned winning combinations, is stopped in the display windows 151 to 155. Here, making any of these combinations is referred to as making a win.

[Base Game Payout Table]

Next, a base game payout table 131 will be described with reference to FIG. 11. The base game payout table 131 indicates the number of coins to be paid out for a winning combination determined by the base game winning combination lottery table shown in FIG. 10. FIG. 11 shows a base game payout table. The base game payout table is stored in the RAM 43, and read during a payout process of the game running process which will be described later.

For a result of sampling using the base game winning combination lottery table 130, coins are paid out in accordance with a winning combination displayed in the display windows 151 to 155 based on the base game payout table 131.

More specifically, when five symbols 180 of "SUN" 181 are stopped in the display windows 151 to 155, seventy coins are paid out. When five symbols 180 of "HEART" 182 are stopped in the display windows 151 to 155, fifty coins are paid out. When five symbols 180 of "MOON" 183 are stopped in the display windows 151 to 155, thirty coins are paid out as a payout. Likewise, when five symbols 180 of "K" 186 are stopped in the display windows 151 to 155, twenty-five coins are paid out as a payout. When five symbols 180 of "A" 184 are stopped in the display windows 151 to 155, twenty coins are paid out as a payout. When five symbols 180 of "Q" 187 are stopped in the display windows 151 to 155, fifteen coins are paid out as a payout. When five symbols 180 of "J" 185 are stopped in the display windows 151 to 155, ten coins are paid out as a payout. When five symbols 180 of "10" 188 are stopped in the display windows 151 to 155, five coins are paid out as a payout. When a lottery results in losing, and a losing combination of symbols 180, which is different from any of the above-mentioned winning combinations, is stopped in the display windows 151 to 155, zero coin is paid out as a payout. Note that, when one coin is inserted for a game, the above-mentioned number of coins are paid out as a payout. When two or more coins are inserted for one game, the number of coins actually paid out is the number of inserted coins being multiplied by the above-mentioned number of coins paid out.

[Electrical Structure of Central Control Board]

FIG. 9 is a block diagram showing an electrical structure of the central control board 210. A control unit is provided within the central control board 210. As shown in FIG. 9, the control unit includes a motherboard 240, a gaming board 250, an actuator, and the like. The central control board 210 functioning as a controller corresponds to the controller 111 shown in FIG. 2.

The gaming board 250 has a CPU (Central Processing Unit) 251, a ROM 255, a boot ROM 252, a card slot 253S corresponding to a memory card 253, and an IC socket 254S corresponding to a GAL (Generic Array Logic) 254. The CPU 251, the ROM 255, and the boot ROM 252 are connected to each other through an internal bus. That is, the gaming board 250 has the same structure and the same function as those of the gaming board 50.

The motherboard 240 has a main CPU 241, a ROM (Read Only Memory) 242, a RAM (Random Access Memory) 243, a power unit 245, a graphic board 268, a common display 201 connected to the graphic board 268, and a communication interface 244. The RAM 243 stores therein a side-bet game payout table 133, a side-bet permission processing program, and a side-bet game running processing program.

The common display 201 has a transparent liquid crystal panel which displays various information. The common display 201 displays display windows 231 to 235 where a plurality of symbols 180 are arranged. In addition, the common display 201 displays as needed game-related various information, effect images, and the like.

This embodiment deals with, as an example, a case where the common display 201 electrically displays symbols 180 to arrange the symbols 180 in five columns and three rows. However, this is not limitative. The symbols 180 may be arranged in three columns and three rows, or five columns and five rows, for example.

In this embodiment, moreover, symbols 180 to be displayed in the display windows 231 to 235 are symbols included in columns formed by the display windows 151 to 155. In other words, the symbols included in the columns formed by the display windows 151 to 155 become symbols 180 to be arranged in the display windows 231 to 235.

The main CPU 241 controls the entire central control board 210. In particular, the main CPU 241 controls the following operations of: outputting a command signal for making the graphic board 268 variably display symbols 180, at a time when a game using the common display 201 is run; and stopping the symbols 180 in the display windows 231 to 235, after the symbols 180 are variably displayed. The main CPU 241 corresponds to the side-bet game running unit 113 shown in FIG. 2. The main CPU 241 also corresponds to the side-bet game win determining unit 114, the side-bet game payout determining unit 115, and the side-bet permission unit 117 shown in FIG. 2.

The communication interface 224 communicates with the communication interfaces 44 of the terminal devices 3A to 3J through a communication line.

The graphic board 268 has the same structure as that of the graphic board 68, except that the graphic board 268 controls image displaying on the common display 201 based on a control signal output from the main CPU 241.

The drive motor 270 is a stepping motor and is connected to a not-shown drive wheel. The drive motor 270 is driven based on a control signal output from the main CPU 241, and rotates the drive wheel to move the common display 201 on the rail 271.

[Sidebet Game Payout Table]

Next, a side-bet game payout table 133 will be described with reference to FIG. 12. The side-bet game payout table 133 indicates the number of coins to be paid out when a predetermined winning combination is achieved in the side-bet game. The number of coins to be paid out is according to the winning combination achieved. FIG. 12 shows a side-bet game payout table. The side-bet game payout table 133 is stored in the RAM 243, and read during a side-bet game running process which will be described later.

When a predetermined winning combination is achieved as a result of the side-bet game, coins are paid out in accordance with the winning combination which is displayed in the display windows 231 to 235 based on the side-bet game payout table 133.

To be more specific, in a case where five symbols 180 of "SUN" 181 are stopped in the display windows 231 to 235, eighty coins are paid out. In a case where five symbols 180 of "HEART" 182 are stopped in the display windows 231 to 235, seventy coins are paid out. In a case where five symbols 180 of "MOON" 183 are stopped in the display windows 231 to 235, sixty coins are paid out. In a case where five symbols 180 of "K" 186 are stopped in the display windows 231 to 235, fifty coins are paid out. In a case where five symbols 180 of "A" 184 are stopped in the display windows 231 to 235, thirty coins are paid out. In a case where five symbols 180 of "Q" 187 are stopped in the display windows 231 to 235, twenty coins are paid out. In a case where five symbols 180 of "J" 185 are stopped in the display windows 231 to 235, ten coins are paid out. In a case where five symbols 180 of "10" 188 are stopped in the display windows 231 to 235, six coins are paid out. When a lottery results in losing, and a losing combination of symbols 180, which is different from any of the above-mentioned winning combinations, is stopped in the display windows 231 to 235, zero coin is paid out as a payout.

[Display State of Display Windows 151 to 155 of Terminal Device]

Figure 5:
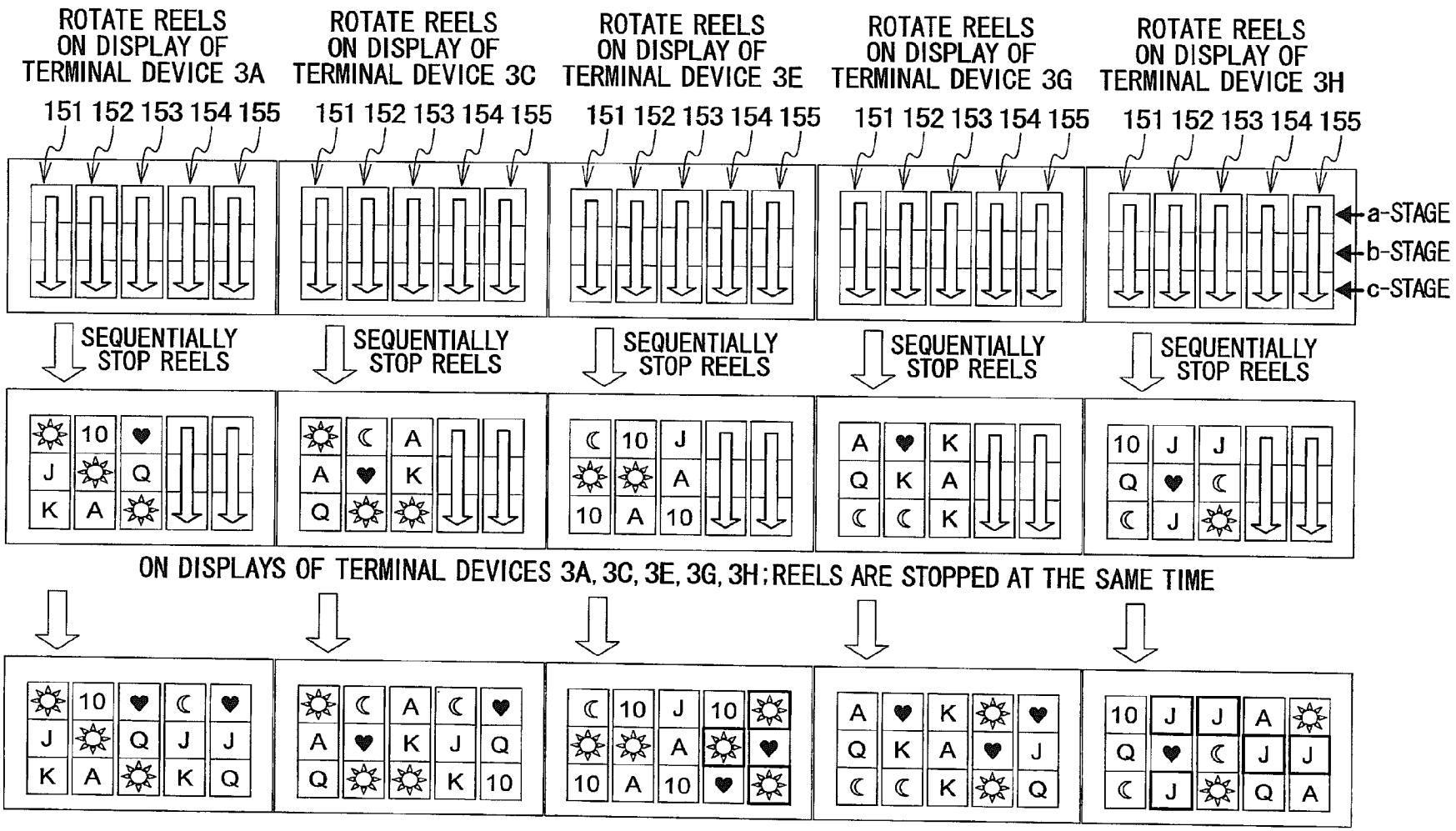
FIG. 5 is an explanatory view showing display screens during a base game.

The following details an exemplary display state of the lower image display panels 16A to 16J of the terminal devices 3A to 3J during operations of the gaming machine 1 and the controlling method thereof. Note that the following example deals with a case where symbols 180 are arranged in the display windows 151 to 155 by means of a video reel method, as shown in FIGS. 1, 5, and 6.

Figure 6:
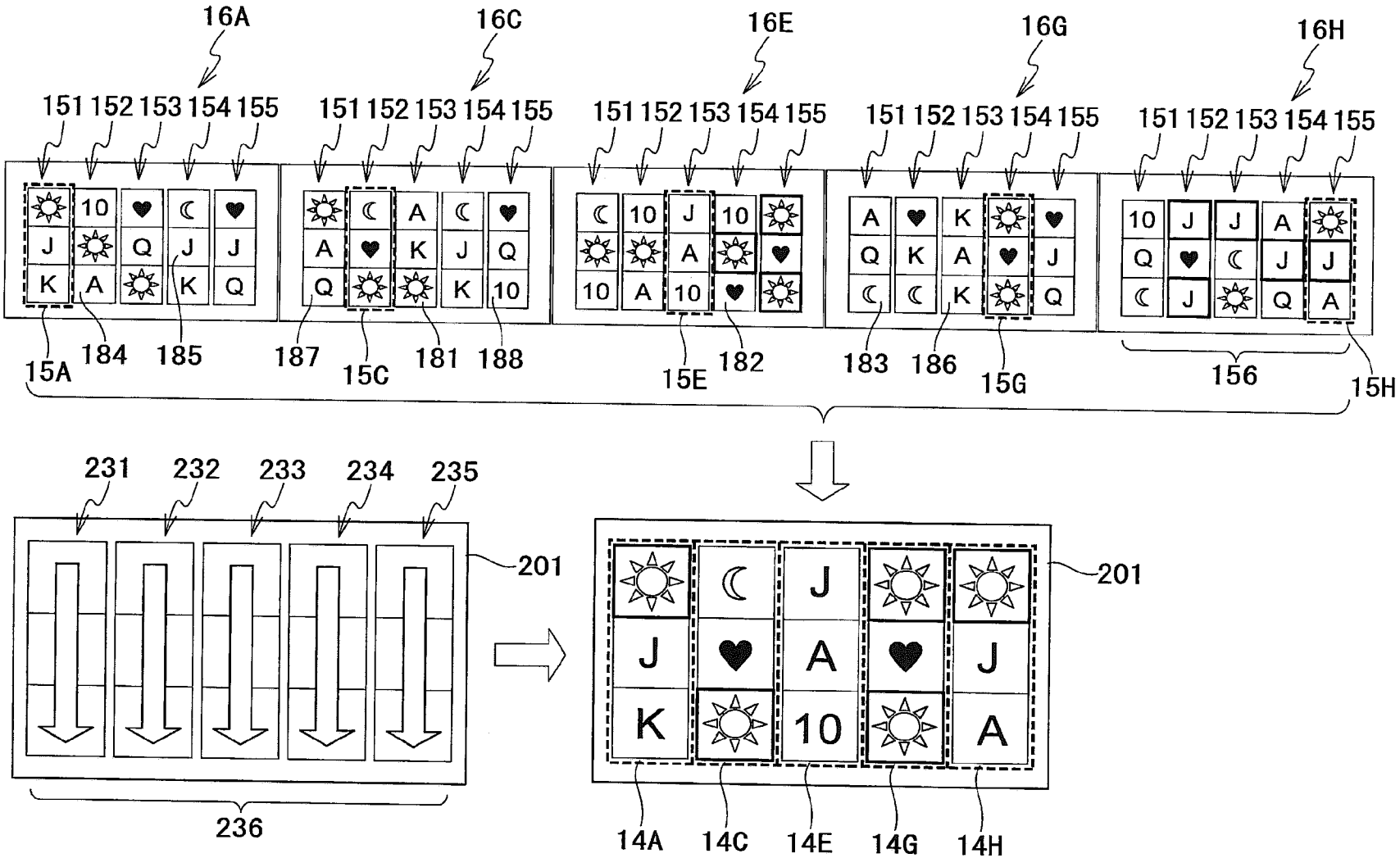
FIG. 6 is an explanatory view showing display screens during a side-bet game.

The lower image display panel 16A to 16J has display windows 151 to 155 where symbols 180 are arranged, as shown in FIG. 6. The display windows 151 to 155 are disposed at a center part of the lower image display panel 16A to 16J. In the display windows 151 to 155, symbol columns (symbol lines A to E) each made up of symbols 180 are scrolled (see FIG. 5). The display windows 151 to 155 are respectively divided into a-stages 151*a* to 155*a*, b-stages 151*b* to 155*b*, and c-stages 151*c* to 155*c*. The symbols 180 are stopped (arranged) in the stages 151*a* to 155*a*, 151*b* to 155*b*, and 151*c* to 155*c*, respectively. For example, in FIG. 6, on the lower image display panel 16A of the terminal device 3A, a symbol of "SUN" 181 is stopped in the a-stage 151*a* of the display window 151, a symbol of "J" 185 is stopped in the central stage 151*b* of the display window 151, and a symbol of "SUN" 181 is stopped in the lower stage 153*c* of the display window 153. In short, the display windows 151 to 155 displays a matrix 156 as an arrangement region made up of five columns and three rows. The matrix 156 however is not limited to the one with the five-columns/three-rows.

In a basic game (base game), a payout awarding process such as paying out coins is executed when a predetermined number of symbols 181 to 188 called scatter symbols are displayed on the lower image display panel 16A to 16J as a winning combination. Scatter symbols are symbols which provide an effective result (such as awarding a payout, giving a bonus game, or the like) merely when a predetermined number of them are stopped on any of the display areas of the arrangement region made up of five columns and three rows of the display windows 151 to 155. For example, when five symbols of "J" 185, which is one of the scatter symbols shown in FIG. 5, are rearranged (displayed) in the display windows 151 to 155, ten coins are paid out as a payout. When five symbols of "HEART" 182, which is one of the scatter symbols, are rearranged (displayed) in the display windows 151 to 155, fifty coins are paid out as a payout.

Although in this embodiment the symbols 181 to 188 are defined as scatter symbols, this is not limitative and only a specific symbol may be defined as a scatter symbol. Alternatively, a player may select a scatter symbol. It may also be possible that a coin payout process or the like is executed when a predetermined combination of symbols is stopped on a payline L extending horizontally through the b-stages (151*b* to 155*b*) of the display windows 151 to 155. That is, the payline L is for determining a combination of symbols 180. When symbols 180 are rearranged on the payline L and outside the payline L, only the symbols 180 rearranged on the payline are judged for a combination. It may be possible that, when a winning combination is made as a result of the determination of a combination, a coin payout process or the like is executed.

[Display State of Display Windows 231 to 235 of Shared Display]

FIG. 6 shows a state where: symbols 180 are rearranged in the display windows 151 to 155 in a base game of the terminal devices 3A to 3J; and, among groups of symbols in five columns thus rearranged, a predetermined column determined at random is rearranged in the display windows 231 to 235 of the common display 201.

Figure 16:
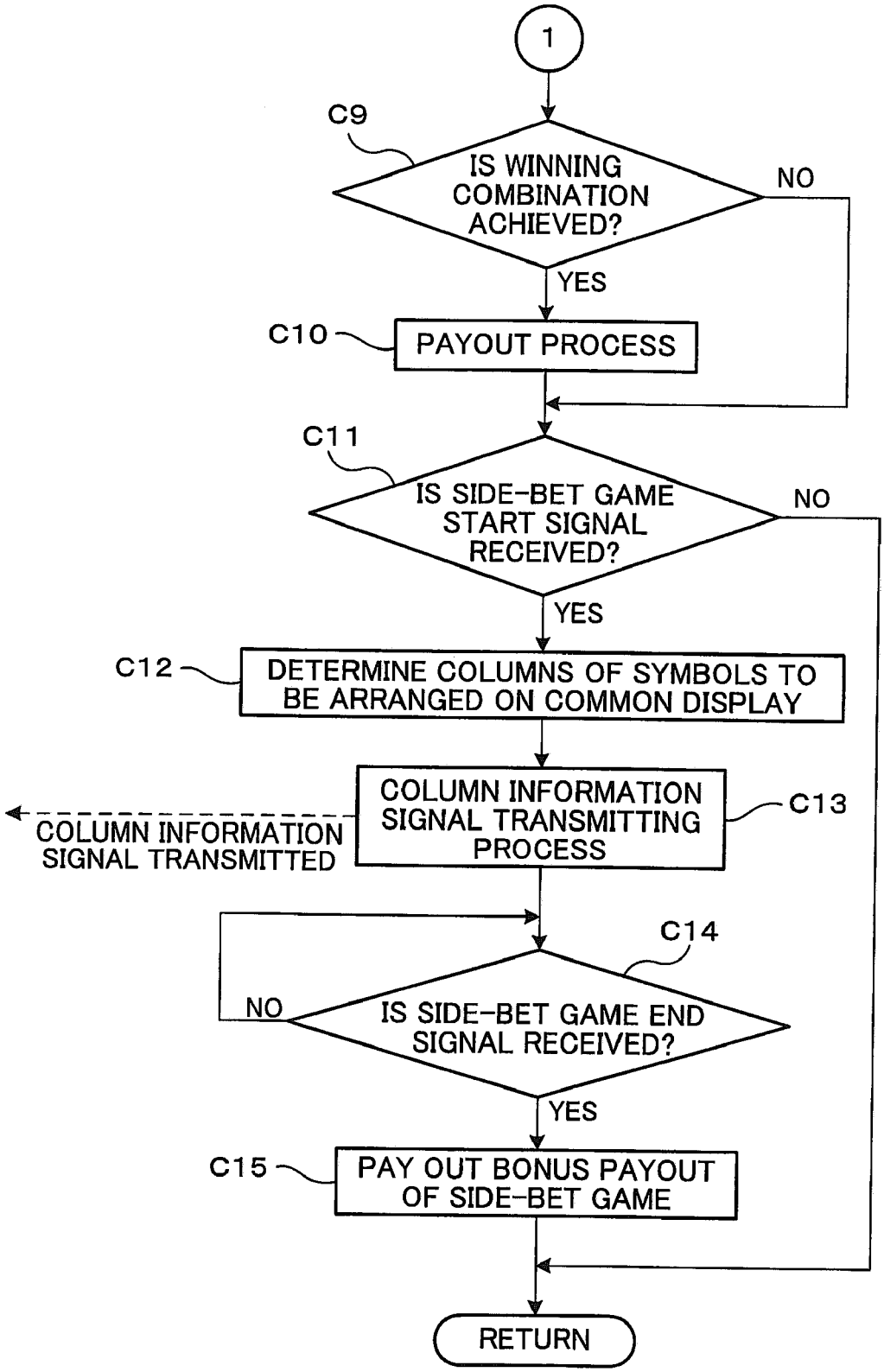
FIG. 16 is a flowchart of a game running process which is executed in the terminal device.

To be more specific, as shown in FIG. 6, a column of symbols 180 in the display window 151 of the lower image display panel 16A (a cursor 15A in FIG. 16) is arranged in a column in the display window 231 of the common display 201 (a cursor 14A in FIG. 16); a column of symbols 180 in the display window 152 of the lower image display panel 16C (a cursor 15C in FIG. 16) is arranged in a column in the display window 232 of the common display 201 (a cursor 14C in FIG. 16); a column of symbols 180 in the display window 153 of the lower image display panel 16E (a cursor 15E in FIG. 16) is arranged in a column in the display window 233 of the common display 201 (a cursor 14E in FIG. 16); a column of symbols 180 in the display window 154 of the lower image display panel 16G (a cursor 15G in FIG. 16) is arranged in a column in the display window 234 of the common display 201 (a cursor 14G in FIG. 16); and a column of symbols 180 in the display window 155 of the lower image display panel 16H (a cursor 15H in FIG. 16) is arranged in a column in the display window 235 of the common display 201 (a cursor 14H in FIG. 16).

Here, FIG. 6 shows a state where symbols 180 are, through scrolling, arranged in the display windows 231 to 235. More specifically, five symbols 180 of "SUN" 181 are arranged in the display windows 231 to 235, so that the winning combination of "SUN" 181 is achieved.

[Symbol Column, etc.]

Symbols 180 displayed in the display windows 151 to 155 of the lower image display panel 16A to 16J of the terminal device 3A to 3J form five symbol columns (symbol lines A to E) each including twenty-two symbols, as shown in FIG. 7. To each of the symbols 180 constituting the columns is given one of code numbers 00 to 21. Each of the symbol columns has a combination of picture symbols of "SUN" 181, "HEART" 182, and "MOON" 183, and letter symbols of "A" 184, "J" 185, "K" 186, "Q" 187, and "10" 188.

Three successive symbols in the symbol columns are displayed (arranged) in the upper stages 151*a*, 152*a*, 153*a*, 154*a*, 155*a*, the center stages 151*b*, 152*b*, 153*b*, 154*b*, 155*b* and the lower stages 151*c*, 152*c*, 153*c*, 154*c*, 155*c* of the display windows 151 to 155, respectively, to form a matrix of five columns and three rows in the display windows 151 to 155. When a BET button is pushed and then a start button is pushed to start a game, the symbols forming the matrix are scrolled. When a predetermined period of time has elapsed after scroll is started, the scroll of each symbol is stopped (rearranged).

The symbols 181 to 188 are set as scatter symbols. Scatter symbols are such symbols that a player is put into an advantageous position when a predetermined number or more of them are displayed in the display windows 151 to 155. The advantageous position is a state where coins corresponding to the scatter symbols are paid out, a state where the number of coins to be paid out is added to a credit, or the like.

For example, when five or more symbols of "MOON" 183 are stopped in the display windows 151 to 155, thirty coins (game media) per bet are paid out.

In this embodiment, a game value is paid out when a predetermined number of predetermined symbols are stopped in the display windows 151 to 155. However, a bonus game may be given instead. The bonus game is a gaming state which is more advantageous than a basic game. For example, the bonus game is a free game. The free game is a game allowing a player to play a game a predetermined number of times without betting a coin. No particular limitation is put on the bonus game, as long as it is a gaming state advantageous to the player, that is, it is more advantageous than the basic game. For example, the bonus game may include a state where more game media are obtainable than in the basic game, a state where a game medium is obtainable with higher probability than in the basic game, a state where a game medium is less consumed than in the basic game, and the like. Specifically, a free game, a second game, a feature game, and the like may be mentioned as examples of the bonus game.

[Operation of Gaming Machine]

Next, various processes executed in the gaming machine 1 will be described. As the main CPU 41 and the main CPU 241 read out and execute programs stored in the ROM 42, the RAM 43, the ROM 242, and the RAM 243, processes relating to various games are run.

[Operation of Gaming Machine: Boot Process]

The following describes a boot process which takes place in the gaming machine 1. Upon powering on the gaming machine 1, a boot processing routine shown in FIG. 13 starts in the mother board 240 and the gaming board 250 in the central control board 210, and in the mother board 40 and the gaming board 50 in the terminal devices 3A to 3J. The memory cards 53 and 253 are assumed to be inserted into the card slots 53S and 253S of the gaming boards 50 and 250, respectively. Further, the GALs 54 and 254 are assumed to be attached to the IC sockets 54S and 254S, respectively.

First, turning on the power switch of (powering on) the power units 45 and 245 boots the motherboards 40 and 240, and the gaming boards 50 and 250. Booting the motherboards 40 and 240 and the gaming boards 50 and 250 starts separate processes in parallel. Specifically, in the gaming board 50 and 250, the CPUs 51 and 251 read out preliminary authentication programs stored in the boot ROMs 52 and 252, respectively. Then, preliminary authentication is performed according to the read out programs so as to confirm and authenticate that no modification is made to authentication programs, before reading them into the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 255 of the gaming boards 50 and 250 via PCI buses, read out authentication programs stored in the ROMs 55 and 265 and store them into the RAMs 43 and 243 (S4). During this step, the main CPUs 41 and 241 each derives a checksum through ADDSUM method (a standard check function) which is adopted in a standard BIOS, and store the authentication programs into the RAMs 43 and 243 while confirming if the operation of storing is carried out without an error.

Next, the main CPUs 41 and 241 each checks what connects to the IDE bus. Then, the main CPUs 41 and 241 accesses, via the IDE buses, to the memory cards 53 and 253 inserted into the card slots 53S and 253S, and read out game programs and game system programs from the memory cards 53 and 253. In this case, the CPUs 41 and 241 each reads out four bytes of data constituting the game program and the game system program at one time. Next, in accordance with the authentication programs stored in the RAMs 43 and 243, the CPUs 41 and 241 authenticate the game program and the game system program read out to confirm and prove that these programs are not modified (S5).

When the authentication properly ends, the main CPUs 41 and 241 write and store the authenticated game programs and game system programs into RAMs 43 and 243 (S6).

Next, the main CPUs 41 and 241 accesses, via the PCI buses, to the GALs 54 and 254 attached to the IC socket 54S and 254S, and read out data from the GALs 54 and 254, respectively. The data read out is then written and stored in the RAMs 43 and 243 (S7).

Next, the main CPUs 41 and 241 read out, via the PCI buses, country identification information stored in the ROMs 55 and 255 of the gaming boards 50 and 250, respectively. The country identification information read out is then written and stored in the RAMs 43 and 243 (S8).

Figure 14:
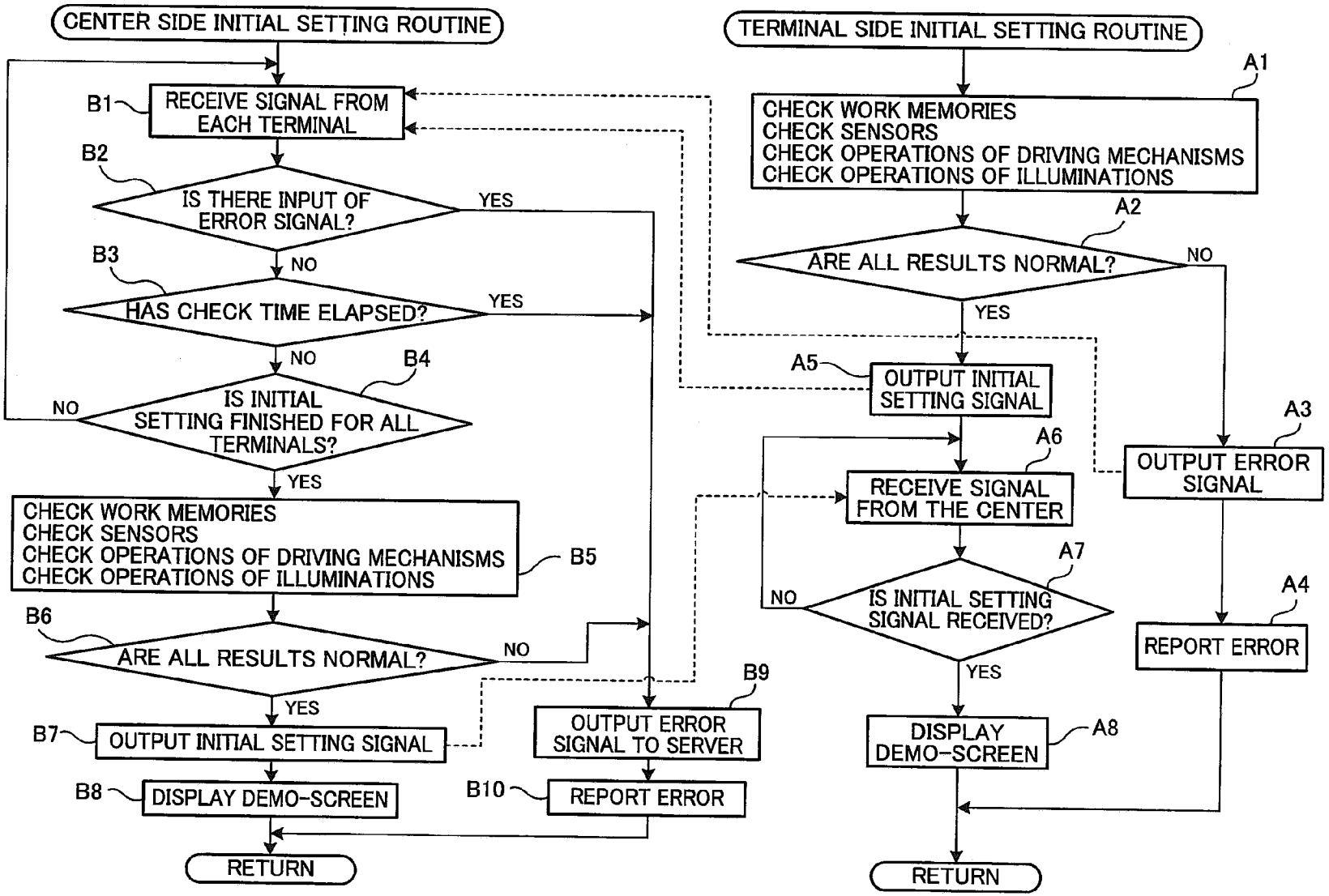
FIG. 14 is a flowchart of an initial process which is executed in the gaming machine.

After this, each of the main CPUs 41 and 241 performs an initial process shown in FIG. 14.

[Operation of Gaming Machine: Initial Process]

Figure 13:
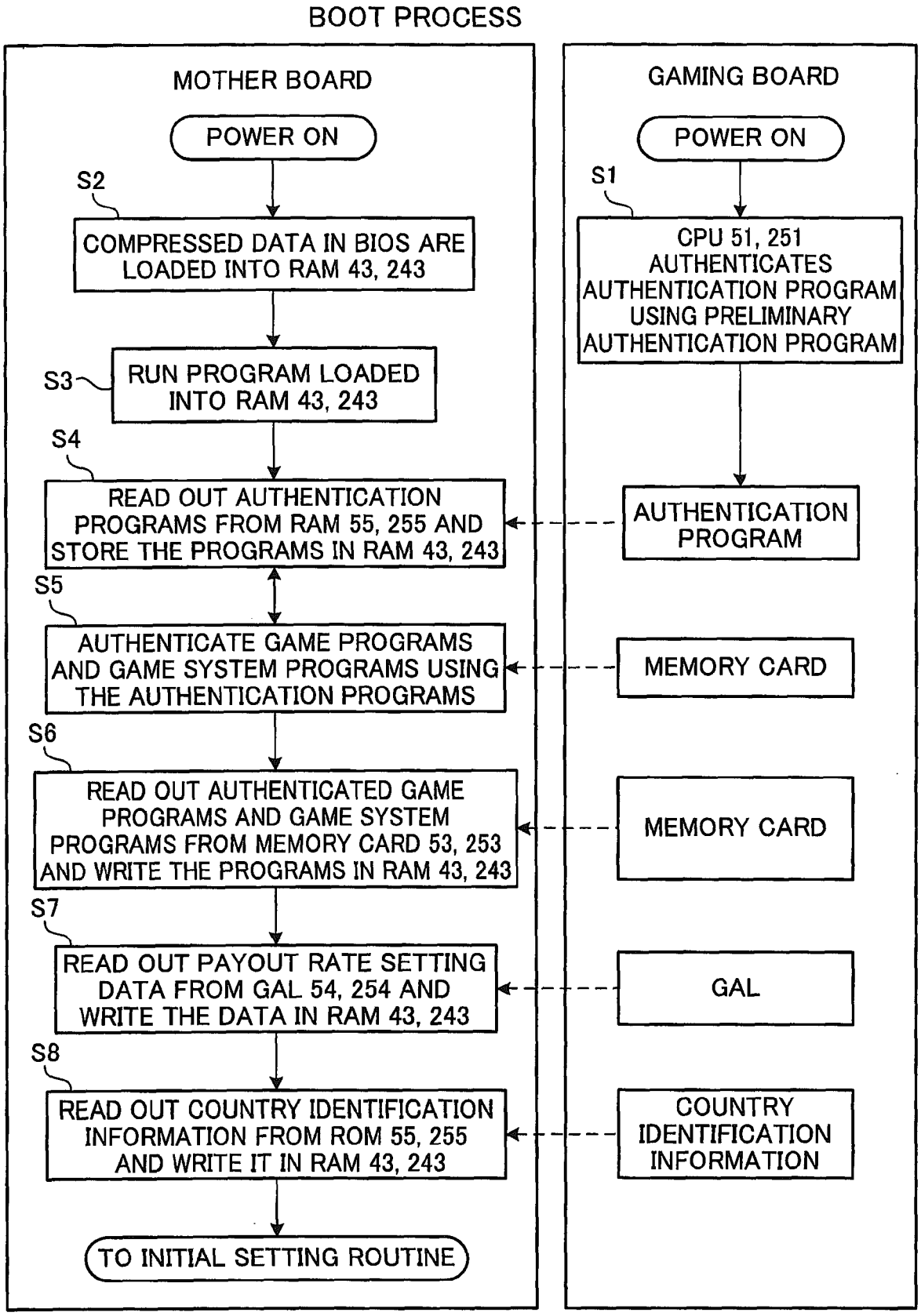
FIG. 13 is a flowchart of a boot process which is executed in the gaming machine.

The following describes an initial process which takes place in the gaming machine 1. When the boot process of FIG. 13 is completed, the central control board 210 reads out from the RAM 243 a center side initial setting routine illustrated in FIG. 14 and executes the routine. Meanwhile, the terminal device 3A to 3J reads out from the RAM 43 a terminal side initial setting routine illustrated in FIG. 14 and executes the routine. The center side and terminal side initial setting routines are executed in parallel.

First, the main CPU 41 of each of the terminal devices 3A to 3J checks operations of work memories such as the RAM 43, various sensors, various driving mechanisms, and various decorative illuminations (A1). Then, the main CPU 41 determines if all the check results are normal (A2). If the main CPU 41 determines that the check results contain an error (A2: NO), the main CPU 41 outputs a signal notifying the error (hereinafter, error signal) to the central control board 210 (A3). Further, the main CPU 41 reports the error by illuminating the lamp 30 or the like (A4), and then ends the routine.

On the other hand in A2, if the main CPU 41 determines that all the check results are normal (A2: YES), an initial setting signal is output to the central control board 210 (A5). Then, an initial setting signal is waited from the central control board 210 (A6, A7: NO).

The main CPU 241 of the central control board 210 receives signals from each of the terminals (B1). Then, the main CPU 241 determines whether a signal received is an error signal (B2). If the main CPU 241 determines that the signal is an error signal (B2: YES), the main CPU 241 outputs an error signal to a management server such as a not-shown host computer (B9) to report the error (B10), and ends the routine.

On the other hand in B2, if the main CPU 241 determines that the signal is not an error signal (B2: NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3:NO), whether an initial setting signal is received from each of the terminal devices 3A to 3J or not is determined (B4). If the main CPU 241 determines that an initial setting signal from any one of the terminal devices 3A to 3J is not received (B4: NO), the process returns to B1. On the other hand, if it is determined that initial setting signals from all the terminal devices 3A to 3J are received (B4: YES), the main CPU 241 checks operations of work memories such as RAM 243 or the like, various sensors, various driving mechanisms, and various decorative illuminations (B5). Then, the main CPU 241 determines whether all the check results are normal (B6). If the main CPU 241 determines the check results contains an error (B6: NO), the main CPU 241 executes B9.

On the other hand in B6, if the main CPU 241 determines that all the check results are normal (B6: YES), the main CPU 241 outputs an initial setting signal to all the terminal devices 3A to 3J (B7), and causes the common display 201 to display a demo-screen (B8). Then, the main CPU 241 ends the routine.

In A7, the main CPU 41 of each of the terminal devices 3A to 3J determines that an initial setting signal is received from the central control board 210 (A7: YES), and causes the upper image display panel 33 to display a demo-screen (A8). The main CPU 41 then ends the routine.

[Operation of Gaming Machine: Game Running Process]

Figure 15:
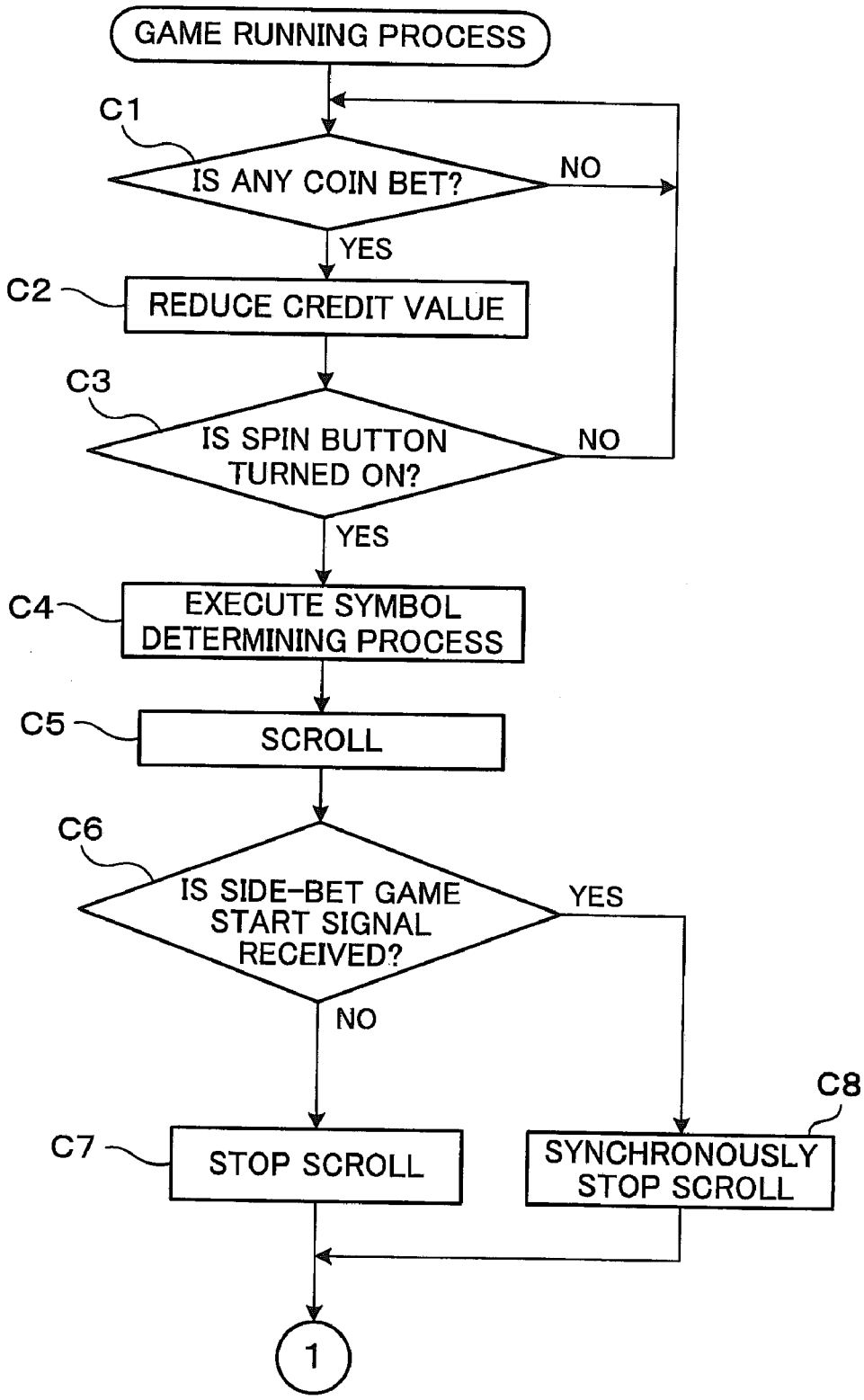
FIG. 15 is a flowchart of a game running process which is executed in the terminal device.

After the terminal side initial setting routine of FIG. 14, the main CPU 41 of the terminal device 3A to 3J reads out and executes the game program and the game system program sequentially, thereby executing a game running process shown in FIGS. 15 and 16. A game running processing program is stored in the RAM 43.

The main CPU 41 of the terminal device 3A to 3J executes the game running process shown in FIGS. 15 and 16. When the game running process is run, first, the main CPU 41 determines whether a coin is bet or not (C1). In this step, whether an input signal from the 1-BET switch 26S entered by pressing of the 1-BET button 26 is received or not is determined. Meanwhile, whether an input signal from the maximum BET switch 27S entered by pressing of the maximum BET button 27 is received or not is determined. If no coin is BET (C1: NO), the step C1 is repeated so that a standby state continues until a coin is bet.

On the other hand, if it is determined that a coin is bet (C1: YES), the credit value stored in the RAM 43 is reduced according to the number of coins bet (C2). When the number of coins bet surpasses the number of coins equivalent to the credit value stored in the RAM 43, the credit value is reduced to zero and he step C3 is performed. When the number of coins bet exceeds the maximum number of coins bet-table on one game (50 pieces in this embodiment), the credit value is reduced by fifty and the step C3 is performed.

Then, whether a spin button 23 is turned on or not is determined (C3). If the spin button 23 is not turned on (C3: NO), the process returns to C1. Here, if the spin button 23 is not turned on (for example, the spin button 23 is not turned on but a command to end the game is input), the reduction of the credit value in C2 is canceled.

On the other hand, when it is determined that the spin button 23 is turned on (C3: YES), a symbol determining process is executed (C4). In other words, a stop symbol determining program is executed based on the base game winning combination lottery table 130 stored in the RAM 43, to determine fifteen symbols 180 to be stopped in the display windows 151 to 155.

Then, symbols 180 in the symbol columns (symbol lines A to E) in the display windows 151 to 155 are scrolled (C5).

Then, whether a side-bet game start signal, which is transmitted during a later-described side-bet permission process, is received or not is determined (C6). When the side-bet game start signal is not received (C6: NO), the symbols 180 determined in C4 are stopped (rearranged) in the display windows 151 to 155, after a predetermined period of time (base time) elapses since the scroll of the symbols 180 is started (C7). When the side-bet game start signal is received (C6: YES), the scroll of the symbols 180 is controlled so as to be synchronized with the scroll of the symbols 180 in other terminal devices 3A to 3J which will participate in the side-bet game, based on stop synchronization information included in the side-bet game start signal. Then, the symbols 180 determined in C4 are stopped (rearranged) in the display windows 151 to 155, in synchronization with stopping of the symbols 180 in the other terminal devices 3A to 3J which will participate in the side-bet game (C8). That is, at the same timing, symbols 180 are rearranged in the display windows 151 to 155 of the terminal devices which will participate in the side-bet game.

Then, whether a win is made or not, that is, whether a combination of symbols 180 stopped in the display windows 151 to 155 is a winning combination listed in the base game payout table 131 or not, is determined (C9). When it is determined that the combination is not a winning combination (C9: NO), the process goes to C11. When it is determined that the combination is a winning combination (C9: YES), a payout process based on the base game is executed (C10). More specifically, the number of coins to be paid out which corresponds to a kind of the winning combination is calculated based on the base game payout table 131 shown in FIG. 11. When coins to be paid out are reserved, a credit value equivalent to the coins is added to the credit value stored in the RAM 43. When the coins are paid out, a control signal is transmitted to the hopper 66 so that a predetermined number of coins are paid out to the coin tray 18. That is, a base payout is awarded in accordance with the winning combination.

Then, whether a side-bet game start signal, which is transmitted during a later-described side-bet permission process, is received or not is determined (C11). When the side-bet game start signal is not received (C11: NO), this process ends.

When the side-bet game start signal is received (C11: YES), a column of symbols to be arranged in the display windows 231 to 235 of the common display 201 is determined (C12). To be specific, a predetermined column (any one of the display windows 151 to 155) is determined at random among the symbols 180 arranged in the display windows 151 to 155 (see FIG. 6).

Then, a column information signal is transmitted (C13). The column information signal includes information about symbols 180 arranged in the predetermined column (any one of the display windows 151 to 155) thus determined.

Then, whether a side-bet game end signal is received or not is determined (C14). When it is determined that the signal is not received (C14: NO), the side-bet game end signal is waited. When it is determined that the signal is received (C14: YES), a payout process for paying out a bonus payout of the side-bet game is executed (C15). More specifically, information about the number of coins to be paid out as a bonus payout of the side-bet game is read out from the side-bet game end signal which is transmitted in F7 of a later-described side-bet game running process. Then, a credit value equivalent to the number of coins read out is added to the credit value stored in the RAM 43. For paying out coins, a control signal is transmitted to the hopper 66 so that coins, the number of which has been read out, are paid out into the coin tray 18. That is, coins as a bonus payout of the side-bet game are paid out. Then, this process once ends.

[Operation of Gaming Machine: Side-Bet Process]

Figure 17:
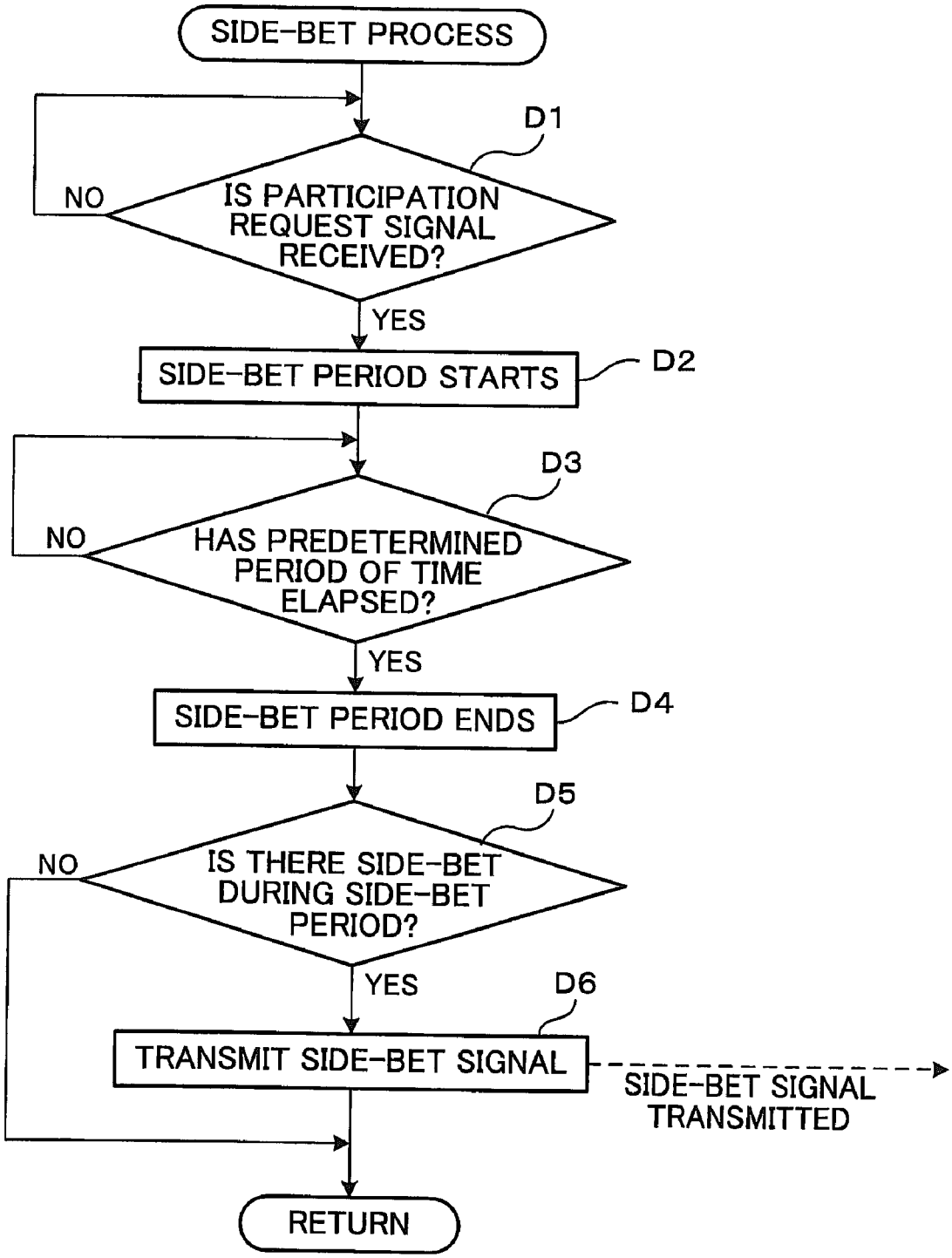
FIG. 17 is a flowchart of a side-bet process which is executed in the terminal device.

The main CPU 41 of each of the terminal devices 3A to 3J executes a side-bet process shown in FIG. 17 in parallel with the game running process. In the side-bet process, whether or not to participate in a side-bet game, which is played using the common display 201, is determined. A side-bet processing program is stored in the RAM 43. FIG. 17 is a flowchart showing a side-bet process.

First, the side-bet process is executed, and whether a participation request signal, which is transmitted during a later-described side-bet permission process, is received or not is determined (D1). When a participation request signal is not received (D1: NO), the signal is waited. When a participation request signal is received (D1: YES), a side-bet period starts (D2).

Then, whether a predetermined period of time has elapsed or not is determined (D3). When a predetermined period of time has not elapsed (D3: NO), a standby state continues until the predetermined period of time elapses. When a predetermined period of time has elapsed (D3: YES), the side-bet period ends (D4). Here, a processing period from D2 to D4 is the side-bet period. During the side-bet period, a coin can be received through the side-bet coin receiving slot 90. That is, during the side-bet period, a player can select to or not to participate in a side-bet game. During the side-bet period, an image effect showing "Side Bet is Possible!" is presented on the lower image display panels 16A to 16J as shown in FIG. 1, to inform players that it is the side-bet period.

Then, whether there has been a side-bet during the side-bet period or not is determined (D5). More specifically, whether an input signal, which is caused by insertion of coins through the side-bet coin receiving slot 90, is transmitted from the side-bet coin counter 90C to the main CPU 41 or not is determined. When there is no side-bet (D5: NO), this process ends. When there is a side-bet (D5: YES), the side-bet signal is transmitted (D6). When coins are inserted into the side-bet coin receiving slots 90 of the respective terminal devices 3A to 3J, an image effect showing "Side Bet was taken!" is presented on the lower image display panels 16A to 16J as shown in FIG. 1, to inform players that there is a side-bet. Then, this process once ends.

[Operation of Gaming Machine: Side-Bet Permission Process]

Figure 18:
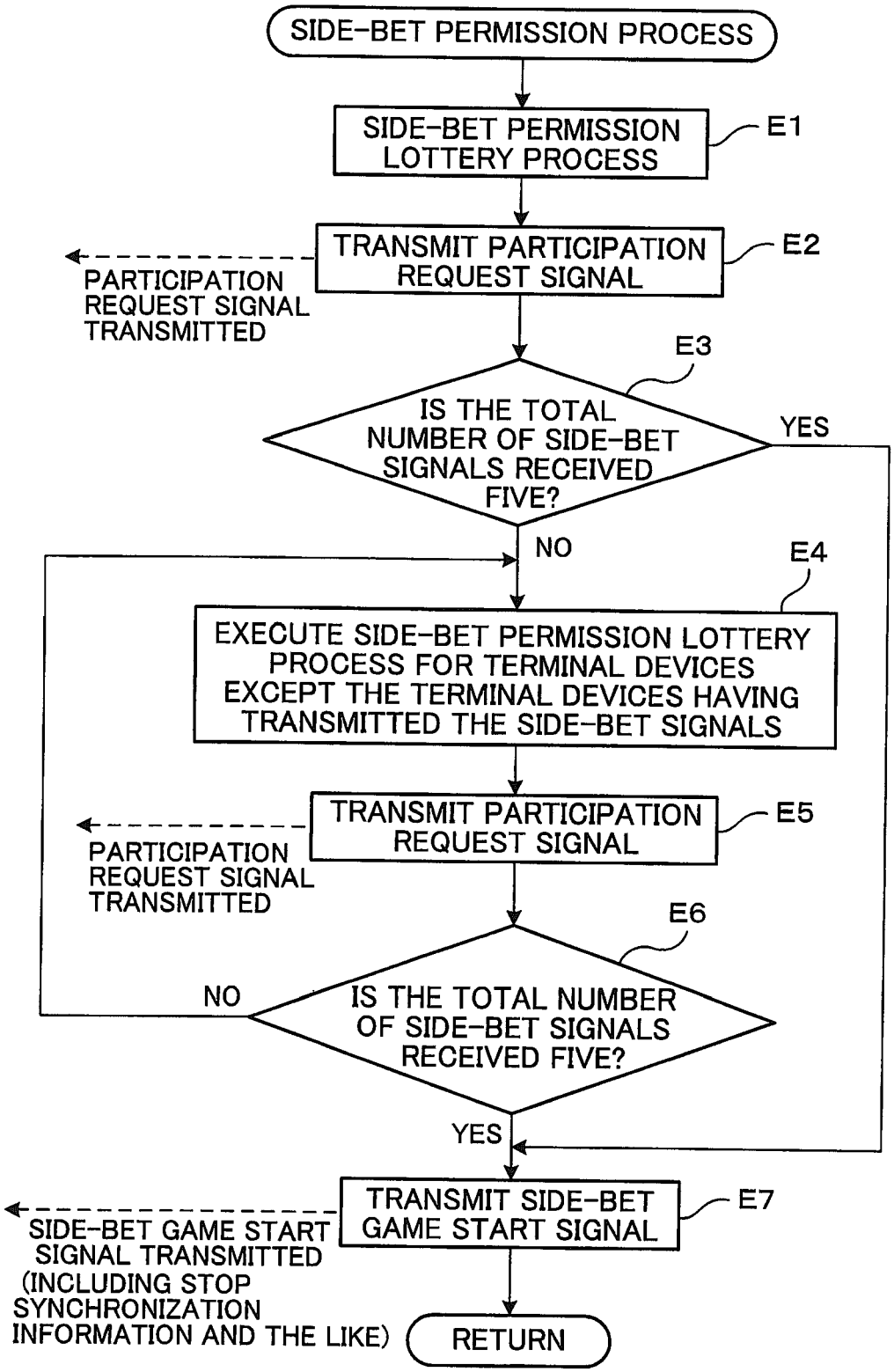
FIG. 18 is a flowchart of a side-bet permission process which is executed in the central control board.

After the center side initial setting routine shown in FIG. 14 ends, the main CPU 241 of the central control board 210 sequentially reads out and executes the game program and the game system program, to thereby execute a side-bet permission process shown in FIG. 18. A side-bet permission processing program is stored in the RAM 243.

In the side-bet permission process, a side-bet permission lottery process is first executed (E1). Specifically, five terminal devices are determined at random among the terminal devices 3A to 3J. Then, in E2, a participation request signal is transmitted to the five terminal devices determined in E1. The participation request signal is for permitting participation in a side-bet game.

Then, whether the total number of side-bet signals received, which are transmitted in D6 of the side-bet process, is five or not is determined (E3). When the total number of side-bet signals received is five (E3: YES), the process goes to E7. When the total number of side-bet signals received is not five (E3: NO), the side-bet permission lottery process is executed for terminal devices except the terminal devices having transmitted the side-bet signals (E4). To be more specific, a predetermined number of terminal devices are determined at random among the terminal devices 3A to 3J except the terminal devices having transmitted the side-bet signals. The predetermined number is a value obtained by subtracting from "five" the number of terminal devices having transmitted the side-bet signals. Then, a participation request signal, which is for permitting participation in a side-bet game, is transmitted to the terminal devices determined in E4.

Then, whether the total number of side-bet signals received, including the ones received in E3, is five or not is determined (E6). When the total number is not five (E6: NO), the process returns to E4. When the total number is five (E6: YES), a side-bet game start signal is transmitted (E7). The side-bet game start signal includes stop synchronization information for synchronizing scrolling and stopping (rearranging) of symbols 180 in the terminal devices having made side-bets. Then, this process once ends.

[Operation of Gaming Machine: Side-Bet Game Running Process]

Figure 19:
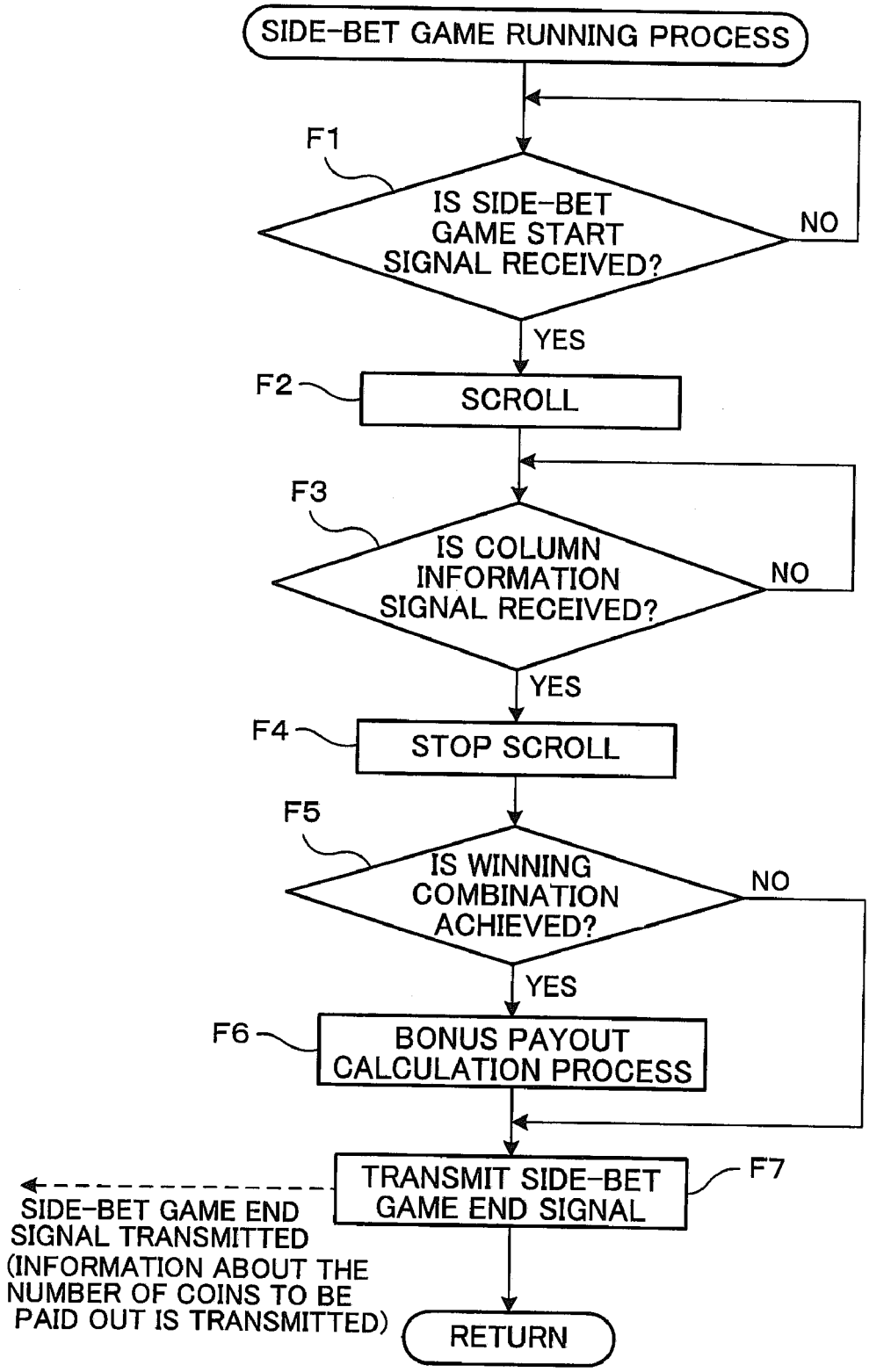
FIG. 19 is a flowchart of a side-bet game running process which is executed in the central control board.

After the center side initial setting routine shown in FIG. 14 ends, the main CPU 241 of the central control board 210 reads out and executes the game program and the game system program sequentially, thereby running the side-bet game running process shown in FIG. 19. A side-bet game running processing program is stored in the RAM 243.

In the side-bet game running process, whether a side-bet game start signal, which is transmitted in the side-bet permission process, is received or not is first determined (F1). When the signal is not received (F1: NO), the step F1 is repeated. When the signal is received (F1: YES), symbol lines (reels) are scrolled in the display windows 231 to 235 (F2).

Then, whether a column information signal, which is transmitted in the game running process, is received or not is determined (F3). When the signal is not received (F3: NO), the signal is waited. When the signal is received (F3: YES), the scroll is stopped (F4). That is, symbols 180 are stopped (rearranged) in the display windows 231 to 235.

Then, whether a winning combination is made or not, that is, whether a combination of symbols 180 stopped in the display windows 231 to 235 forms a winning combination shown in the side-bet game payout table 133 or not is determined (F5). When it is determined that a winning combination is not made (F5: NO), the process goes to F7. When it is determined that a winning combination is made (F5: YES), a bonus payout calculation process is executed to calculate a bonus payout of the side-bet game (F6). That is, the number of coins to be paid out corresponding to a kind of the winning combination is calculated, based on the side-bet game payout table 133 shown in FIG. 12. Then, a side-bet game end signal is transmitted (F7). The side-bet game end signal includes information about the number of coins to be paid out as a bonus payout of the side-bet game calculated in F6. Then, this process once ends.

According to the above-described structure, a result of a game occurring on the common display 201 depends on lines or columns of symbols rearranged in the surrounding terminal devices 3A to 3J. This may allow a player to enjoy the game while feeling some togetherness (unity) with other players playing on the neighboring terminal devices 3A to 3J.

In addition, timing for rearranging symbols 180 in the terminal devices 3A to 3J having selected to participate in a side-bet game can be synchronized among a predetermined number of terminal devices 3A to 3J having selected to participate in the side-bet game. That is, lines or columns of symbols 180 rearranged in the respective terminal devices 3A to 3J are concurrently rearranged on the common display 201. As a result, the players participating in the game occurring on the common display 201 can recognize a result of the game at the same time. This may allow a player to enjoy the game while feeling some togetherness (unity) with players playing on the neighboring terminal devices 3A to 3J.

[Operation of Gaming Machine: Effect Operation]

When the above-described various processes are executed in the gaming machine 1, results or contents corresponding to the processes are, in the form of commands or data, input to respective actuators. For example, when in each of the terminal devices 3A to 3J coins are inserted into the side-bet coin receiving slot 90 so that a side-bet is made, the main CPU 41 receives an input signal from the side-bet coin counter 90C and blinks the lamp 30. In addition, when coins are inserted into the side-bet coin receiving slot 90 so that a side-bet is made, the main CPU 41 displays an effect image on the upper image display panel 33. Moreover, the main CPU 41 performs effect presentation by an audio output from the speaker 29, together with or independently of the effect made on the upper image display panel 33.

When insertion of coins into the side-bet coin receiving slot 90 is admitted, an image effect showing "Side Bet is Possible!" is presented on the lower image display panel 16A to 16J (see FIG. 1). In addition, when coins are inserted into the side-bet coin receiving slot 90 of the terminal device 3A to 3J, an image effect showing "Side Bet was taken! " is presented on the lower image display panel 16A to 16J (see FIG. 1).

In the detailed description provided above, characteristic parts have mainly been described in order that the present invention can be understood more easily. However, the present invention is not limited to the embodiment shown in the detailed description provided above, and may be applied to other embodiments. The scope of application of the present invention should be construed as broadly as possible. Terms and phraseologies adopted in the present specification are for correctly illustrating the present invention, not for limiting. It would be easy for those skilled in the art to derive, from the spirit of the invention described in the present specification, other structures, systems, methods and the like which are included in the spirit of the invention. Accordingly, it should be considered that claims cover equivalent structures, too, without departing from the technical idea of the present invention. An object of the abstract is to enable an intellectual property office, general public institutions, persons belonging to the art but not familiar with patent, legal terms, or technical terms to quickly understand technical contents and essences of the present invention through a simple research. Therefore, the abstract is not intended to limit the scope of the invention that should be evaluated by the claims. In addition, it is desirable to sufficiently refer to already-disclosed documents and the like, in order to fully understand the objects and effects of the present invention.

The detailed description provided above includes a process which is executed on a computer or a computer network. The descriptions and expressions provided above are given for the purpose of allowing those skilled in the art to understand the invention most effectively. In the specification, respective steps used to induce one result, or blocks having a predetermined processing function should be understood as a process having no self-contradiction. In addition, in each step or block, an electrical or magnetic signal is transmitted/received, recorded, and the like. In a process in each step or block, such a signal is embodied in the form of a bit, a value, a symbol, a character, a term, a number, and the like. However, it should be noted that they have been used simply because they are convenient for explanations. A process in each step or block has sometimes been described using an expression which is common to a human behavior. However, in principle, the process described in the specification is executed by a variety of devices. In addition, other structures necessary for each step or block are apparent from the above description.

What is claimed is:

1. A gaming machine comprising:

a common display which arranges a plurality of symbols in a matrix of arrangement areas;

a plurality of terminal devices each having a terminal display which arranges a plurality of symbols in a matrix of arrangement areas and each having a side-bet device configured to accept a player's selection as to whether to participate in a game occurring on the common display, the terminal device rearranging the plurality of symbols in the arrangement areas on the terminal display and running a game to award a base payout in accordance with a relation among the rearranged symbols; and a controller which is programmed to operate in the steps of:

(a1) extracting a predetermined number of randomly selected terminal devices without replacement from the plurality of terminal devices;

(a2) bringing side-bet devices of the extracted terminal devices into a selectable state for receiving a selection;

(a3) receiving at least one selection to participate via at least one side-bet device in a selectable state;

(a4) repeating the steps (a1) to (a3) for a predetermined amount of time until the number of terminal devices having selected to participate in a game occurring on the common display reaches a predetermined value;

(a5) rearranging, on the common display, predetermined symbols among the symbols rearranged in the predetermined number of terminal devices selected by the side-bet devices; and (a6) awarding a bonus payout to the terminal devices having selected to participate in the game occurring on the common display, in accordance with a relation among the predetermined symbols rearranged on the common display.

2. The gaming machine according to claim 1, wherein the controller synchronizes, among the predetermined number of terminal devices selected by the side-bet devices, timing for rearranging the symbols in the terminal devices selected by the side-bet devices.

3. A gaming machine comprising:

a common display which arranges a plurality of symbols in a matrix of arrangement areas;

a plurality of terminal devices each having a terminal display which arranges a plurality of symbols in a matrix of arrangement areas and each having a side-bet device configured to accept a player's selection as to whether to participate in a game occurring on the common display, the terminal device rearranging the plurality of symbols in the arrangement areas on the terminal display and running a game to award a base payout in accordance with a relation among the rearranged symbols; and a controller which is programmed to operate in the steps of:

(b1) extracting a predetermined number of randomly selected terminal devices without replacement from the plurality of terminal devices;

(b2) bringing side-bet devices of the extracted terminal devices into a selectable state for receiving a selection;

(b3) receiving at least one selection to participate via at least one side-bet device in a selectable state;

b(4) repeating the steps (b1) to (b3) for a predetermined amount of time until the number of terminal devices having selected to participate in a game occurring on the common display reaches a predetermined value;

b(5) extracting symbols, on a line or column basis, from the symbols rearranged in the matrixes of arrangement areas of the predetermined number of terminal devices selected by the side-bet devices;

b(6) rearranging, on the common display, a combination of the symbols extracted on a line or column basis in the predetermined number of terminal devices selected by the side-bet device; and (b7) awarding a bonus payout to the terminal devices having selected to participate in the game occurring on the common display, in accordance with a relation among the symbols rearranged on the common display.

4. The gaming machine according to claim 3, wherein the controller synchronizes, among the predetermined number of terminal devices selected by the side-bet devices, timing for rearranging the symbols in the matrixes of arrangement areas of the terminal devices selected by the side-bet devices.

5. The gaming machine according to claim 3, wherein, in the step (b1), the predetermined number of terminal devices extracted from the plurality of terminal devices is equal to the number of lines or columns constituting the matrix of arrangement areas of the common display.

6. The gaming machine according to claim 3, wherein:

in the step (b1), the predetermined number of terminal devices extracted from the plurality of terminal devices is equal to the number of lines or columns constituting the matrix of arrangement areas of the common display; and the controller synchronizes, among the terminal devices selected by the side-bet devices, timing for rearranging the symbols in the matrixes of arrangement areas of the terminal devices selected by the side-bet devices.

7. A playing method of a gaming machine having a common display which arranges a plurality of symbols in a matrix of arrangement areas; and a plurality of terminal devices each having a terminal display which arranges a plurality of symbols in a matrix of arrangement areas and each having a side-bet device configured to accept a player's selection as to whether to participate in a game occurring on the common display, the terminal device rearranging the plurality of symbols in the arrangement areas on the terminal display and running a game to award a base payout in accordance with a relation among the rearranged symbols, the method comprising the steps of:

(1) extracting a predetermined number of randomly selected terminal devices without replacement from the plurality of terminal devices;

(2) bringing side-bet devices of the extracted terminal devices into a selectable state for receiving a selection;

(3) receiving at least one selection to participate via at least one side-bet device in a selectable state;

(4) repeating the steps (1) to (3) for a predetermined amount of time until the number of terminal devices having selected to participate in a game occurring on the common display reaches a predetermined value;

(5) rearranging, on the common display, predetermined symbols among the symbols rearranged in the predetermined number of terminal devices selected by the side-bet devices; and (6) awarding a bonus payout to the terminal devices having selected to participate in the game occurring on the common display, in accordance with a relation among the predetermined symbols rearranged on the common display.

* * * * *